US010080413B2

(12) United States Patent
Everett, Jr. et al.

(10) Patent No.: US 10,080,413 B2
(45) Date of Patent: Sep. 25, 2018

(54) HEATED APPLIANCE

(71) Applicant: Spectrum Brands, Inc., Middleton, WI (US)

(72) Inventors: David William Everett, Jr., Verona, WI (US); Vignesh Manikandan Pirathaban, Madison, WI (US); Justin Jeffrey Chaudoir, Madison, WI (US); Gianna Sophia Lint, Cornelius, NC (US); Maciej Murzynski, Verona, WI (US)

(73) Assignee: Spectrum Brands, Inc., Middleton, WI (US)

( * ) Notice: Subject to any disclaimer, the term of this patent is extended or adjusted under 35 U.S.C. 154(b) by 289 days.

(21) Appl. No.: 14/688,984

(22) Filed: Apr. 16, 2015

(65) Prior Publication Data

US 2015/0296950 A1 Oct. 22, 2015

Related U.S. Application Data

(60) Provisional application No. 61/980,468, filed on Apr. 16, 2014, provisional application No. 62/015,796, filed on Jun. 23, 2014.

(51) Int. Cl.

| | |
|---|---|
| ***A45D 1/04*** | (2006.01) |
| ***A45D 2/00*** | (2006.01) |
| *A45D 1/28* | (2006.01) |

(52) U.S. Cl.

CPC ..... *A45D 1/04* (2013.01); *A45D 2/001* (2013.01); *A45D 1/28* (2013.01)

(58) Field of Classification Search

CPC . A45D 1/04; A45D 2/001; A24D 1/28; H05B 1/0288

USPC ..... 219/225, 524, 497, 543, 545, 537

See application file for complete search history.

(56) References Cited

U.S. PATENT DOCUMENTS

| | | | | |
|---|---|---|---|---|
| 4,354,092 | A * | 10/1982 | Manabe | H05B 3/42 132/232 |
| 4,691,486 | A | 9/1987 | Niekrasz et al. | |
| 4,971,848 | A * | 11/1990 | Ruelle | H05B 3/84 428/38 |
| 6,051,820 | A | 4/2000 | Poix et al. | |
| 6,184,502 | B1 * | 2/2001 | Haazendonk | H05B 3/748 219/460.1 |
| 6,914,220 | B2 * | 7/2005 | Tian | F27B 17/0025 219/385 |

(Continued)

FOREIGN PATENT DOCUMENTS

| | | |
|---|---|---|
| WO | 2006018701 A2 | 2/2006 |
| WO | 2006075140 A1 | 7/2006 |

(Continued)

OTHER PUBLICATIONS

ISR/WO dated Aug. 31, 2015, PCT/US2015/026260 filed Apr. 16, 2015, Spectrum Brands, Inc., 14 pages.

*Primary Examiner* — Mark Paschall
(74) *Attorney, Agent, or Firm* — Armstrong Teasdale LLP

(57) ABSTRACT

A heated appliance generally includes a pair of arms and a hinge attaching the arms together such that the arms are openable and closeable relative to one another via the hinge. Each of the arms includes a heating element having a multi-pane glass substrate and an electrically conductive material deposited on the glass substrate.

19 Claims, 27 Drawing Sheets

(56) References Cited

U.S. PATENT DOCUMENTS

| | | | | |
|---|---|---|---|---|
| 7,745,759 | B2 * | 6/2010 | Long | A47J 31/20 219/214 |
| 8,895,897 | B2 * | 11/2014 | Dixon | H05B 3/84 219/201 |
| 9,150,196 | B2 * | 10/2015 | Choi | H05B 3/84 |
| 2009/0114639 | A1 * | 5/2009 | Werkman | D06F 75/24 219/543 |
| 2011/0011846 | A1 | 1/2011 | Soerensen et al. | |
| 2013/0192625 | A1 | 8/2013 | Migliori et al. | |

FOREIGN PATENT DOCUMENTS

| | | | |
|---|---|---|---|
| WO | 2013117418 | A1 | 8/2013 |
| WO | 2014001769 | A1 | 1/2014 |

* cited by examiner

HEATED APPLIANCE

CROSS-REFERENCE TO RELATED APPLICATIONS

This application claims the benefit of U.S. Provisional Application No. 61/980,468 filed on Apr. 16, 2014 and U.S. Provisional Application No. 62/015,796 filed on Jun. 23, 2014, which are incorporated by reference herein in their entirety.

BACKGROUND

The present invention relates generally to a heated appliance and, more particularly, to a heated grooming appliance such as a hair straightener.

Many conventional hair straighteners have a pair of arms that are hingedly connected together to permit manual opening and closing of the arms relative to one another for straightening hair therebetween. Each arm typically includes a housing, a metallic hair-contacting member (such as an aluminum plate) mounted on the housing, and a heating element (such as a positive temperature coefficient "PTC" heating element) disposed within the housing and fastened to the backside of the hair-contacting member. When electrical current is provided to the PTC heating element, the PTC heating element heats the hair-contacting member via conduction.

However, conventional hair straighteners tend to have an undesirable heat-up time due, at least in part, to the slower rate of conductive heat transfer between the PTC heating element and the metallic hair-contacting member (i.e., the metallic hair-contacting member has a higher density and, therefore, a slower rate of conductive heat transfer). Moreover, PTC heating elements tend to be heavier and thicker that is desired, and conventional hair straighteners tend to have an undesirable weight and an undesirably thick profile as a result.

There is a need, therefore, for a hair straightener that is lighter in weight, has a shorter heat-up time, and/or has a thinner profile as compared to at least some conventional hair straighteners.

SUMMARY

In one embodiment, a heated appliance generally comprises a pair of arms and a hinge attaching the arms together such that the arms are openable and closeable relative to one another via the hinge. Each of the arms comprises a heating element having a multi-pane glass substrate and an electrically conductive material deposited on the glass substrate.

In another embodiment, a heated appliance generally comprises a heating element and a control unit configured to sample temperature data from the heating element when the heating element is heated to a set temperature. The control unit is also configured to determine a rate of temperature change for the heating element using the sampled temperature data. The control unit is further configured to supply a percentage of full power to the heating element. The percentage of full power is selected by the control unit from a plurality of percentages of full power based at least in part upon the determined rate of temperature change.

In yet another embodiment, a hair straightener generally comprises a first arm and a second arm hingedly connected to one another. The hair straightener also comprises a thin-film heating element attached to one of the arms, wherein the heating element comprises a glass substrate and an electrically conductive layer deposited on the substrate. The hair straightener further comprises a thermistor attached to the heating element and configured for gauging a temperature of the heating element during operation of the straightener. The hair straightener further comprises a control unit carried by the one of the arms. The control unit is configured to sample temperature data from the heating element when the heating element is heated to a set temperature. The control unit is also configured to determine a rate of temperature change for the heating element using the sampled temperature data. The control unit is further configured to supply a percentage of full power to the heating element, wherein the percentage of full power is selected by the control unit from a plurality of percentages of full power based at least in part upon the determined rate of temperature change.

BRIEF DESCRIPTION

FIG. 19 is an enlarged segment of the flow chart of FIG. 18;

FIG. 26 is another enlarged segment of the flow chart of FIG. 18;

Corresponding reference characters indicate corresponding parts throughout the several views of the drawings.

DETAILED DESCRIPTION

Figure 1:
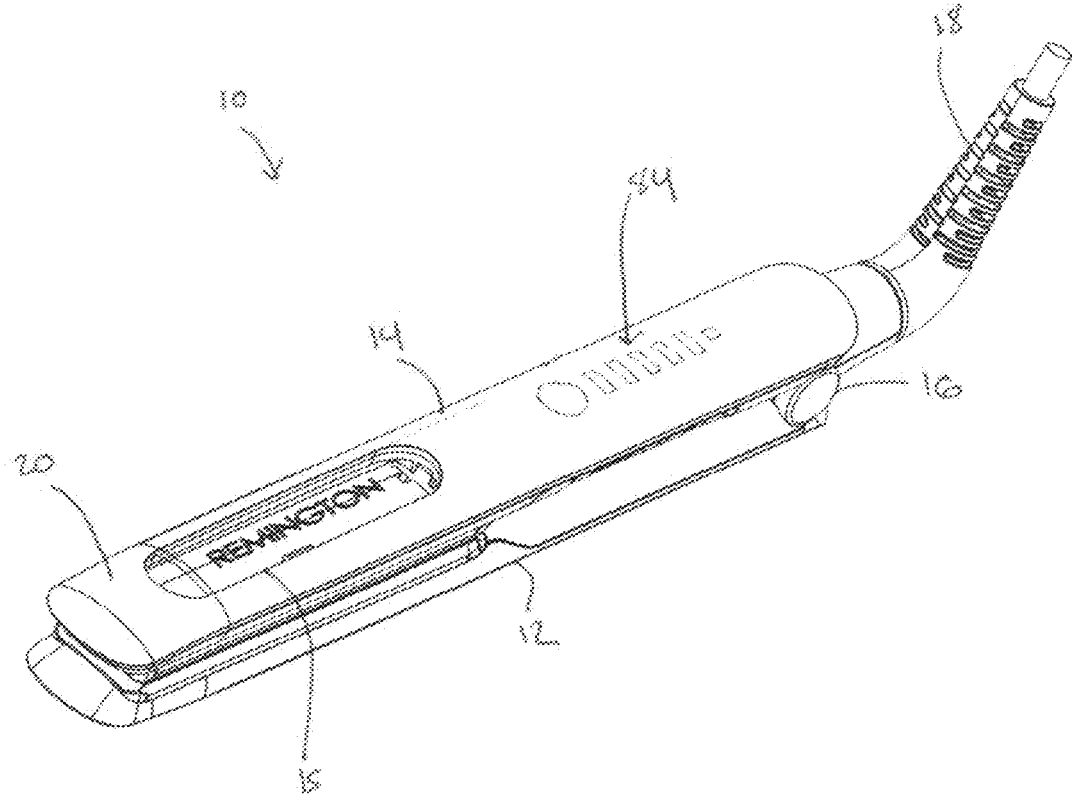
FIG. 1 is a perspective view of an embodiment of a heated appliance.
Figure 2:
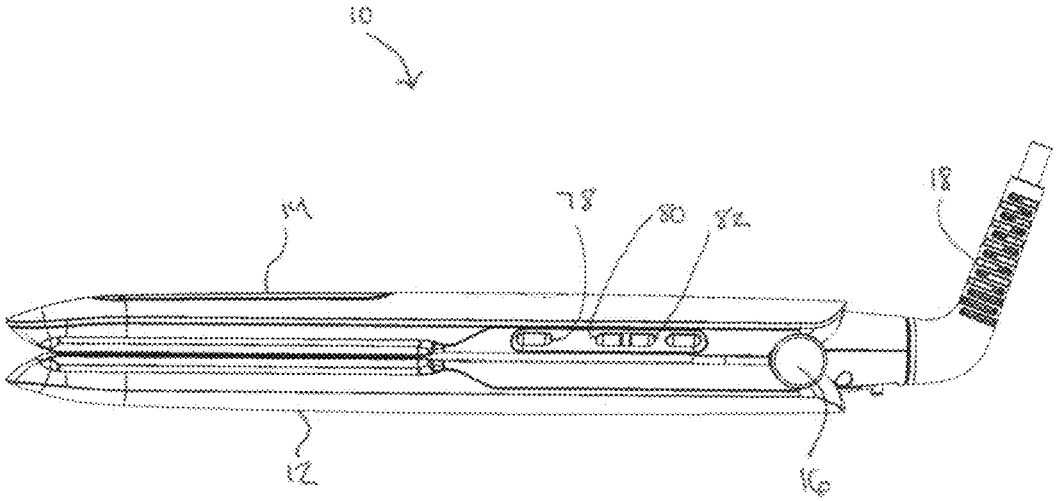
FIG. 2 is a side view of the appliance of FIG. 1.

Referring now to the drawings, and in particular to FIGS. 1 and 2, a heated appliance according to one embodiment is illustrated in the form of a hair straightener (indicated generally by the reference numeral 10). It is contemplated, however, that the embodiments described herein may be useful on other electric appliances such as, for example, hair curling irons, clothing irons, grills, toasters, toaster ovens, pizza ovens, hairdryers, coffeemakers, fish tanks, terrariums, kettles, steam mops, etc.

The illustrated hair straightener 10 comprises a pair of arms (namely, a first arm 12 and a second arm 14), a hinge 16 by which the arms 12, 14 are connected together, and a power cord 18. The hinge 16 is configured to facilitate opening and closing the arms 12, 14 relative to one another. For operating the straightener 10 in the manner set forth herein, the arm 14 is provided with a power button (or "ON/OFF" key 78), a temperature increase button (or "UP" key 80), a temperature decrease button (or "DOWN" key 82), and a graphical user interface (e.g., an LCD display, indicated generally by reference numeral 84). In addition, the first arm 12 and/or the second arm 14 may be provided with a substantially transparent viewing window 15 which enables a user to see through the entire arm 12, 14 for viewing hair disposed between the arms 12, 14 during a hair straightening operation. Suitably, in other embodiments, the straightener 10 may be configured in any manner that facilitates user operation of the straightener 10 as set forth herein (e.g., the straightener 10 may have any suitable number of buttons and displays arranged in any suitable manner).

Figure 3:
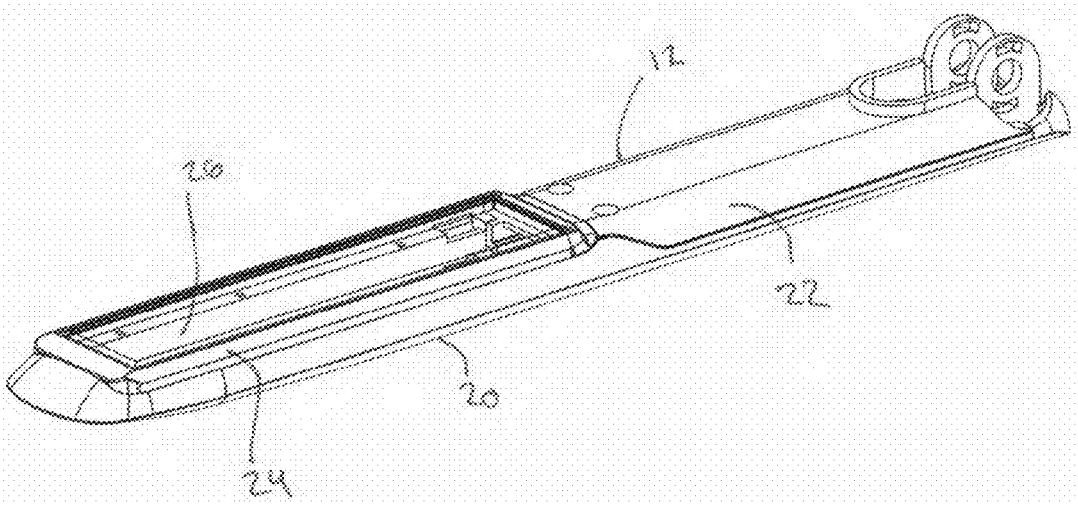
FIG. 3 is a perspective view of an arm of the appliance of FIG. 1.
Figure 4:
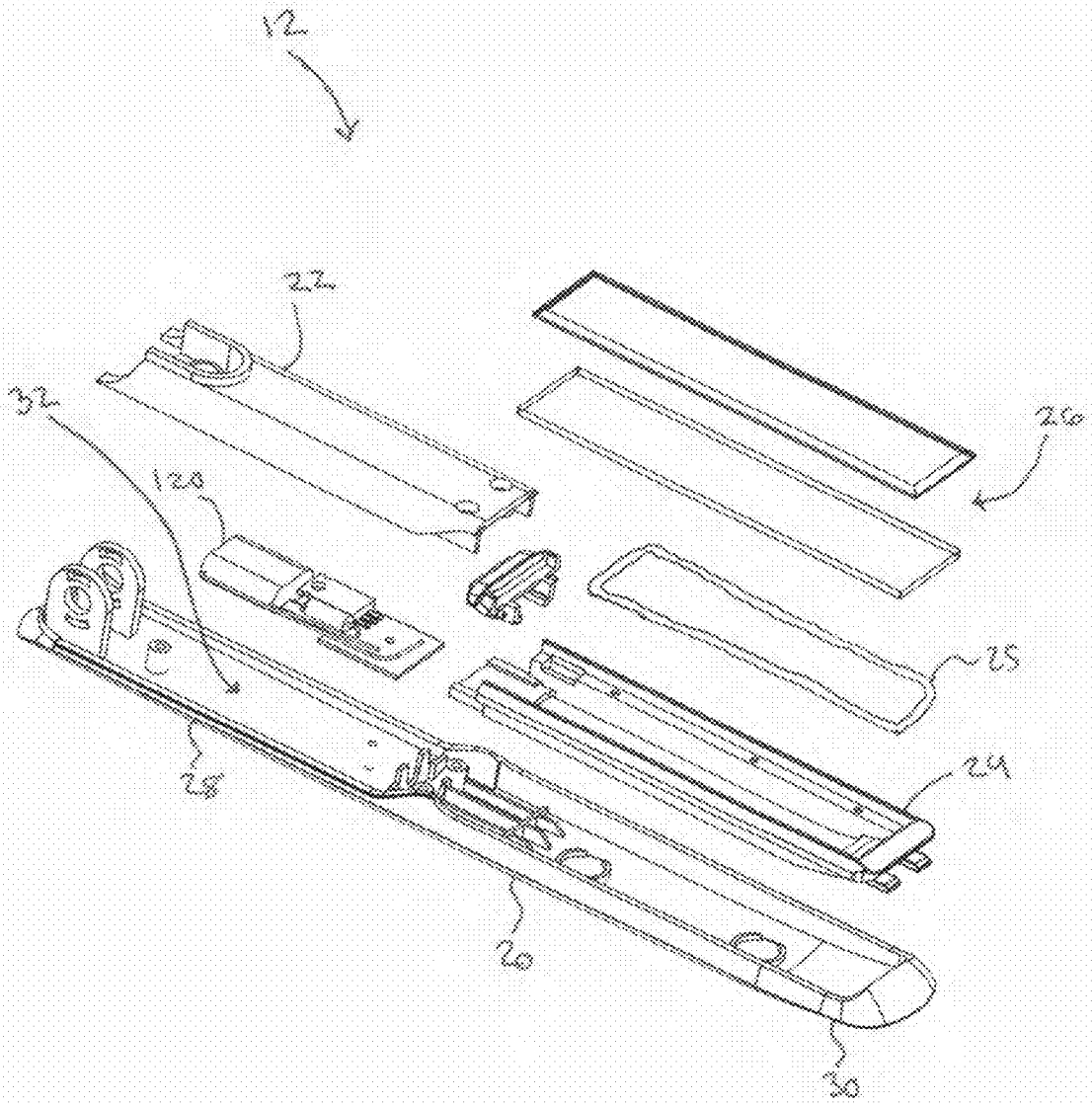
FIG. 4 is an exploded view of the arm of FIG. 3.

Referring now to FIGS. 3 and 4, each arm 12, 14 generally includes a housing 20, a cover 22, a chassis 24, and a heating element (indicated generally by reference numeral 26). In the illustrated embodiment, the housing 20 has a back region 28 and a front region 30, and the cover 22 is connected to the back region 28 to define an interior space 32 in which circuitry and other operational components of the hair straightener 10 (e.g., a control unit 120) can be stored. The front region 30 of the housing 20 is configured to receive the chassis 24, which in turn is configured to receive the heating element 26 such that the heating element 26 is oriented for contacting hair disposed between the arms 12, 14 during a hair straightening operation. In some embodiments, the hair straightener 10 may be configured for cordless operation using a rechargeable power supply, which may also be stored within the interior space 32 defined between the cover 22 and the back region 28 of the housing 20.

Figure 5:
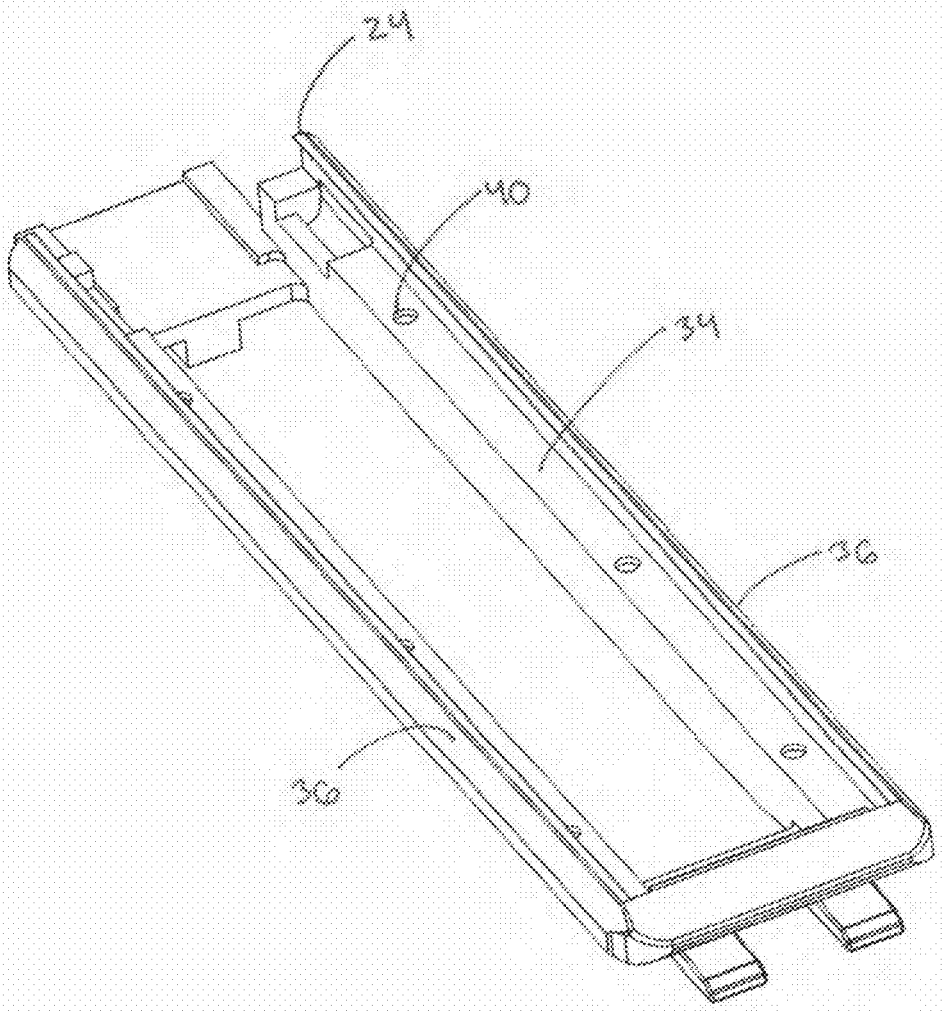
FIG. 5 is a perspective view of a chassis of the arm of FIG. 4.
Figure 6:
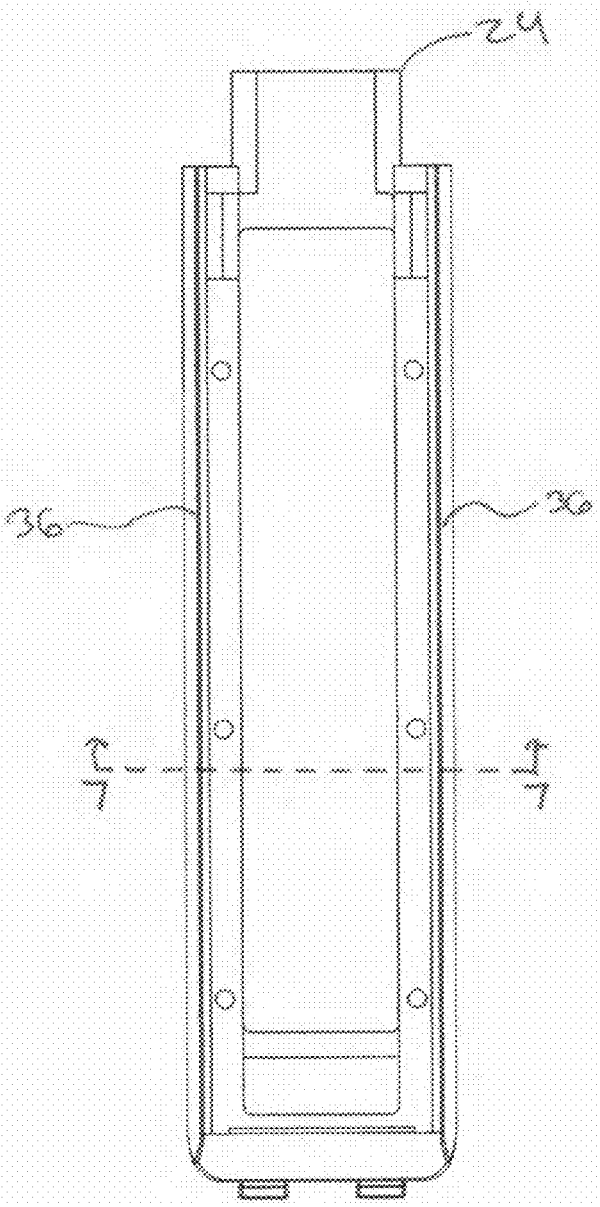
FIG. 6 is a top view of the chassis of FIG. 5.
Figure 7:
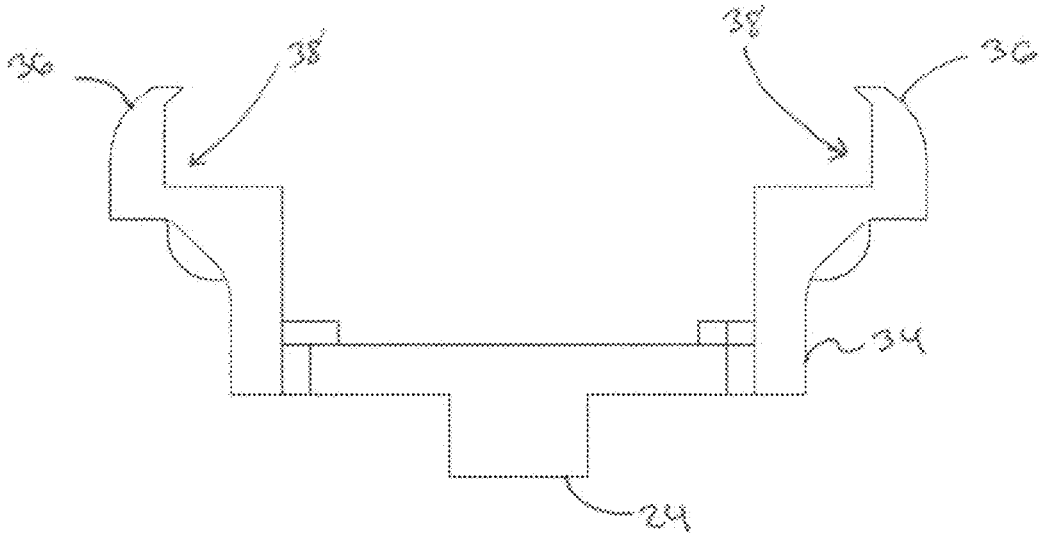
FIG. 7 is a cross-sectional view of the chassis of FIG. 5 taken along plane 7-7 of FIG. 6.

As shown in FIGS. 5-7, the illustrated chassis 24 has a base 34 and a pair of rails 36 projecting from the base 34. Each rail 36 defines a channel (generally indicated by reference numeral 38) in which a side of the heating element 26 is to be received. Moreover, the base 34 has a plurality of slots 40, in each of which is seated a tab (not shown) (e.g., a rubber or foam spacer). The tabs facilitate supporting (or cushioning) the heating element 26 on the base 34 in spaced relation (e.g., the tabs facilitate elevating the heating element 26 above the base 34 by virtue of the heating element 26 being seated on the tabs). Alternatively, in one contemplated embodiment, an annular (e.g., generally rectangular), compressible (e.g., resilient) gasket 25 (shown in FIG. 4) may be seated on the base 34 beneath the heating element 26. The gasket 25 facilitates insulating between the base 34 and the heating element 26 near the periphery of the heating element 26, while also supporting (or cushioning) the heating element 26 on the base 34 in spaced relation and inhibiting the ingress of pollutants (e.g., debris, hairspray, water, etc.) between the heating element 26 and the base 34. In other embodiments, the chassis 24 may be configured to retain and support the heating element 26 in any suitable manner that facilitates enabling the heating element 26 to function as described herein.

Figure 8:
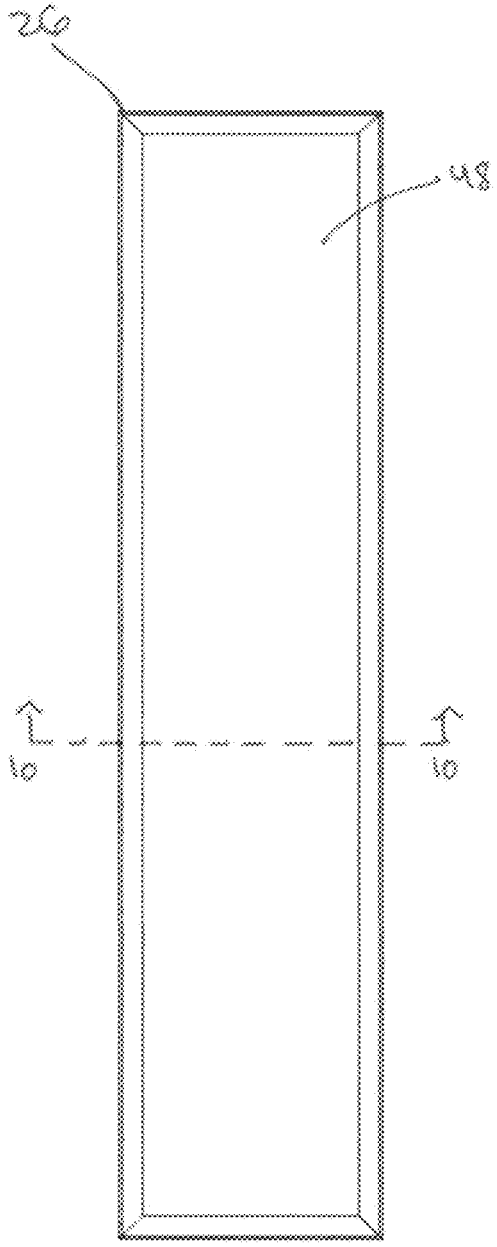
FIG. 8 is a top view of a heating element of the arm of FIG. 4.
Figure 9A:
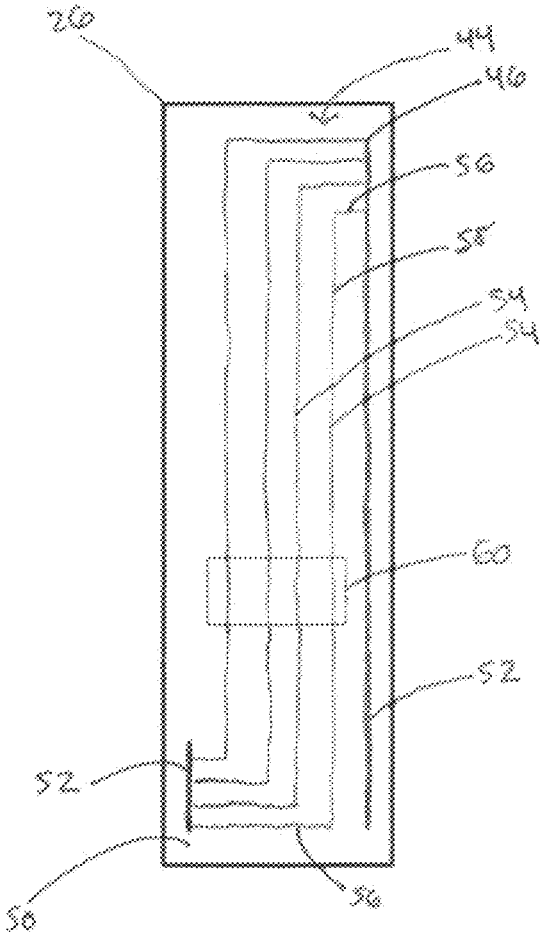
FIG. 9A is a bottom view of the heating element of FIG. 8 with electrically conductive material deposited thereon in a pattern of one embodiment.
Figure 9B:
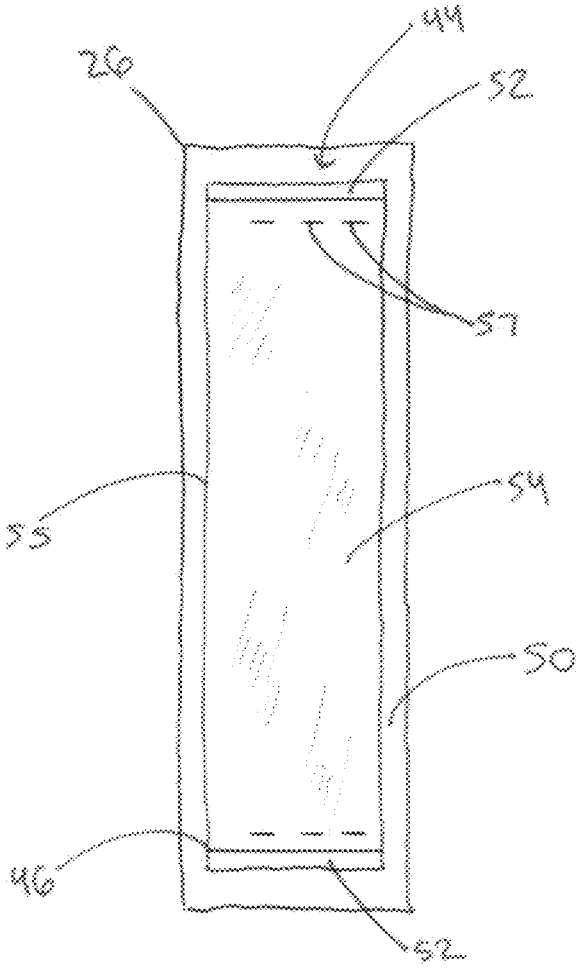
FIG. 9B is a bottom view of the heating element of FIG. 8 with electrically conductive material deposited thereon in a pattern of another embodiment.
Figure 10:
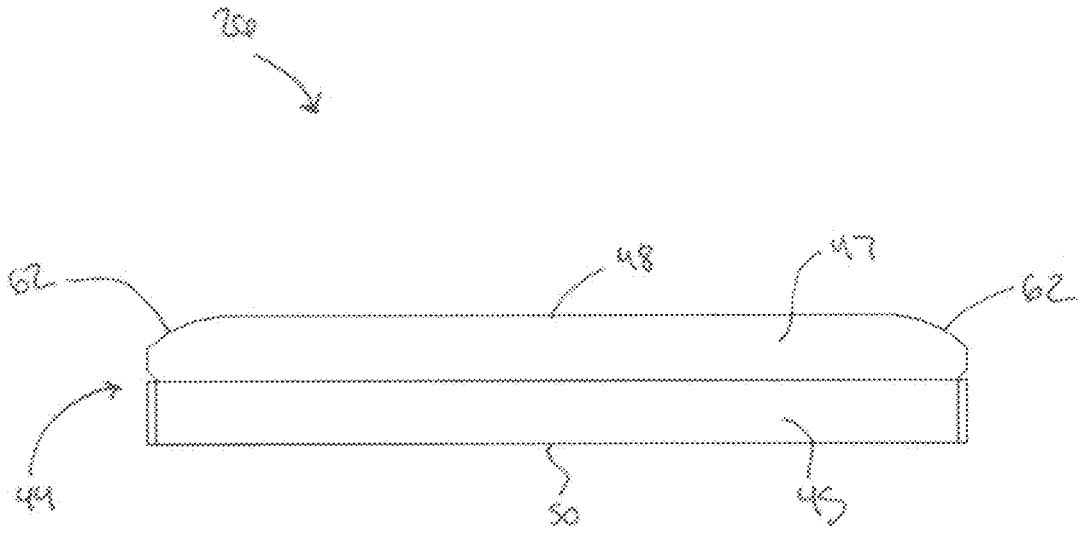
FIG. 10 is a cross-sectional view of the heating element of FIG. 8 taken along plane 10-10 of FIG. 8.

With reference to FIGS. 8-10, the heating element 26 is a thin-film heating element having a substrate (indicated generally by reference numeral 44) and an electrically conductive material 46 deposited on the substrate 44 for heating the substrate 44. As used herein, the heating element 26 is said to be a "thin-film" heating element in the sense that the substrate 44 and the electrically conductive material 46 have a collective thickness that is only marginally greater than the thickness of the substrate 44 itself (i.e., the material 46 forms a thin film on the substrate 44).

In the illustrated embodiment, the substrate 44 is fabricated from a glass material, and the electrically conductive material 46 is composed of a metal oxide material (e.g., a tin oxide material). In the illustrated embodiments, the material 46 has the following specifications: (1) a maximum instantaneous power of about 160-360 W per heating element 26; (2) a voltage of about 120-240 VAC; (3) a resistance of about 60-160 Ohms per heating element 26; (4) a maximum instantaneous current of about 1.3-2 A per heating element 26; (5) a maximum instantaneous watt density of about 50-120 WSI per heating element 26; and (6) an operating temperature of about 150-235° C. Alternatively, in other embodiments, the material 46 may have any suitable specifications.

Generally, it is preferable to fabricate the substrate 44 from a glass material that has a higher resistance to fracture, with the expectation that the user may drop the straightener 10 or otherwise cause the heating element(s) 26 to impact other objects. To facilitate this goal, the entire substrate 44 could in theory be fabricated from a treated glass material because treated glass tends to have a higher fracture resistance. However, when the electrically conductive material 46 is deposited on the substrate 44, the substrate 44 may be subjected to extreme temperatures that could weaken the treated glass's fracture resistance capability. As such, it may be undesirable in some instances to fabricate the entire substrate 44 from a treated glass material.

With this principle in mind, the illustrated substrate 44 has a pair of glass panes, namely an inner pane 45 and an outer pane 47 that are adjacent one another (e.g., in abutment with one another). The outer pane 47 is fabricated from a chemically or thermally treated glass material (e.g., the outer pane 47 may be fabricated from a treated aluminosilicate or borosilicate glass material), while the inner pane 45 is not fabricated from a treated glass material (e.g., the inner pane 45 may be fabricated from a glass-ceramic material).

Optionally, the substrate 44 may at least in part be made from a non-glass material (e.g., a non-glass ceramic material) in other embodiments.

The multi-pane configuration of the illustrated embodiment enables the electrically conductive material 46 to be deposited on the substrate 44 without weakening the fracture resistance capability of the portion of the substrate 44 that is exposed to the user and, hence, is most susceptible to fracture. Moreover, such a multi-pane configuration also facilitates reducing leakage current from the heating element 26 to the user, in that the multi-pane configuration provides (at the interface of the panes 45, 47) a level of contact resistance that serves as an added safeguard against leakage current to the user. In other embodiments, however, the substrate 44 may be fabricated from any suitable material that facilitates enabling the heating element 26 to function as described herein (e.g., the substrate 44 may have any suitable number and type of glass panes arranged in any suitable manner).

In the illustrated embodiment, the outer pane 47 has an exterior (or hair-contacting) face 48 (shown in FIGS. 8 and 10), and the inner pane 45 has an interior face 50 (shown in FIGS. 9A, 9B, and 10). The electrically conductive material 46 is deposited on the interior face 50 of the substrate 44. In the embodiment illustrated in FIG. 9A, the material 46 is deposited on the interior face 50 such that the material 46 defines a network of current carrying members, namely a pair of bus members 52 and a plurality of connection members 54. Moreover, each of the bus members 52 is substantially linear, and the bus members 52 are oriented substantially parallel with one another on the substrate 44. In alternative embodiments, however, the bus members 52 may be arranged in any suitable manner.

Moreover, each of the illustrated connection members 54 is substantially Z-shaped, with its ends electrically connected to the bus members 52 such that the connection members 54 span the area between the bus members 52. In the illustrated embodiment, the connection members 54 are arranged so as to appear stacked atop of one another. More specifically, being that each substantially z-shaped connection member 54 has a pair of end segments 56 and a cross segment 58 extending between the end segments 56, the various connection members 54 are arranged such that the analogous end segments 56 are substantially parallel with one another, and such that the cross segments 58 are substantially parallel with one another. This pattern facilitates generating a desirable heating profile for the substrate 44.

Alternatively, the electrically conductive material 46 may be deposited on the interior face 50 as illustrated in FIG. 9B, with the material 46 defining a pair of bus members 52 and a single connection member 54 therebetween. The bus members 52 are substantially parallel with the short sides of the substrate 44. The connection member 54 is in the form of a strip 55 of material 46 having a substantially uniform thickness throughout, and the connection member 54 completely covers a central region of the interior face 50 between the bus members 52 so as to leave only a thin border (or margins) of the interior face 50 uncovered. Notably, the only areas of the interior face 50 between the bus members 52 that remain uncovered by the connection member 54 are those areas associated with a plurality of etched slits 57 (or perforations) that are oriented substantially parallel to the bus members 52.

Optionally, in other contemplated embodiments, the substrate 44 and the material 46 may be fabricated from any suitable compositions (e.g., the material 46 may have a composition other than a tin oxide composition). Moreover, the material 46 may be deposited so as to have any suitable number and arrangement of current carrying members (e.g., bus members 52 and/or connection members 54) each having any suitable shape and being bonded or otherwise connected to the substrate 44 in any suitable manner that facilitates enabling the material 46 to function as described herein. For example, in some embodiments, the material 46 may be embedded in the substrate 44, as opposed to being deposited on the interior face 50 as set forth above.

When the straightener 10 is operated (using either the embodiment of FIG. 9A or FIG. 9B), an electrical current is supplied to the electrically conductive material 46 from a rechargeable power supply housed within the interior space 32 and/or from a remote power supply via the power cord 18, using the control unit 120 of the straightener 10 as set forth in more detail below. The current flows from one bus member 52 to the other through the connection member(s) 54. Because the material 46 naturally resists the flow of current therethrough, the material 46 heats up as a result. Such heating of the material 46 causes the substrate 44 to be heated by virtue of the substrate 44 being in conductive heat transfer with the material 46. Notably, for the embodiment of FIG. 9B in particular, the slits 57 facilitate increasing the electrical resistance of the connection member 54 near the bus members 52 to provide for a more even heat distribution across the connection member 54, considering that the connection member 54 would otherwise have a tendency to generate more heat near its center than near the bus members 52 (i.e., the slits 57 facilitate evening the heat profile across the strip 55 from one bus member 52 to the other).

With the bus members 52 electrically connected to the power supply via the control unit 120 in any suitable manner, the control unit 120 can modulate the flow of electrical current from the power supply through the electrically conductive material 46 during operation of the straightener 10, as set forth in more detail below. As such, the control unit 120 can control the temperature of the substrate 44 during operation of the straightener 10.

With particular reference again to the embodiment of FIG. 9A, because the control unit 120 is communicatively coupled to a thermistor 60 operatively connected to the heating element 26, the control unit 120 can also gauge the temperature of the substrate 44 during operation of the straightener 10. The thermistor 60 may have any suitable operative connection to the heating element 26 (e.g., the thermistor 60 may be fixed in direct contact with the interior face 50 (or any other suitable surface) of the heating element 26 as in the embodiment of FIG. 9A, or the thermistor 60 may be located remotely from (i.e., not in direct contact with) the heating element 26 in other embodiments). Notably, the thermistor 60 may be operatively connected to the heating element 26 of FIG. 9B in the same manner as that of the embodiment of FIG. 9A. Alternatively, the control unit 120 may be configured to function in the manner described herein without communicating with a thermistor, such that straightener 10 may not have the thermistor 60 in other embodiments.

Figure 11:
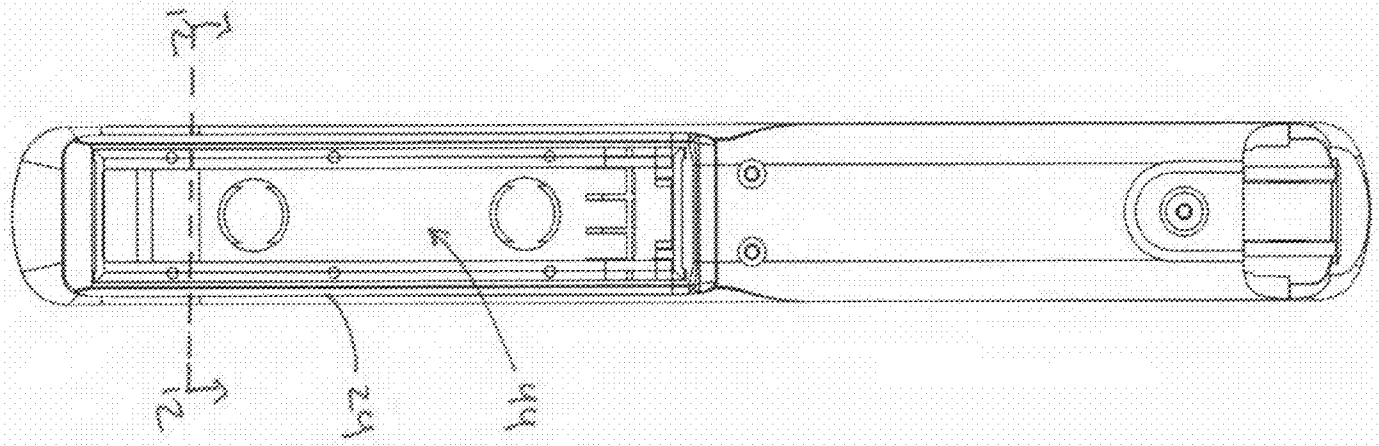
FIG. 11 is a top view of the arm of FIG. 3.
Figure 12:
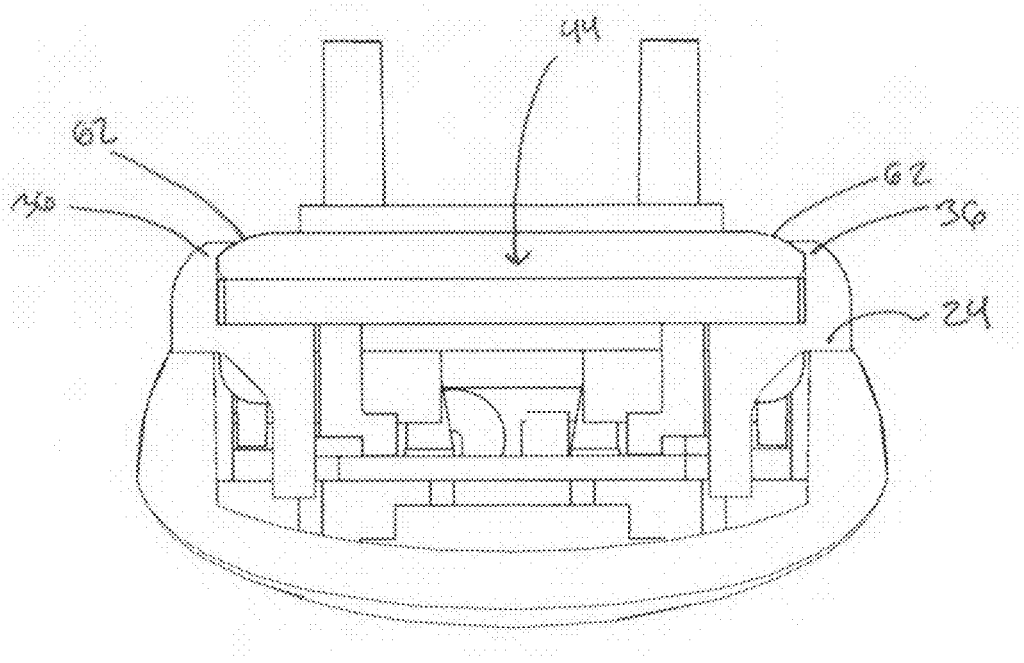
FIG. 12 is a cross-sectional view of the arm of FIG. 3 taken along plane 12-12 of FIG. 11.

Referring now to FIGS. 11 and 12, the illustrated substrate 44 is contoured such that its sides 62 are sized for insertion into the channels 38 of the chassis 24. When the substrate 44 is inserted into the channels 38, the rails 36 wrap over (or cover) at least a portion of the sides 62 of the substrate 44 to facilitate retaining the substrate 44 on the chassis 24. The rails 36 may be contoured in any suitable manner to wrap over (or cover) at least a portion of the sides 62 of the substrate 44.

Figure 13:
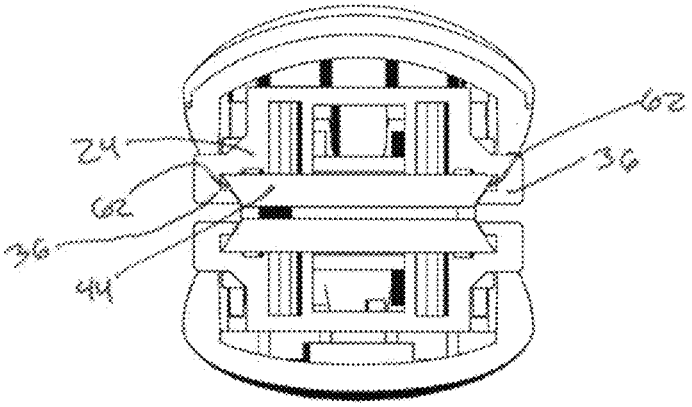
FIG. 13 is a cross-sectional view of a first alternative embodiment of the arm of FIG. 3.
Figure 14:
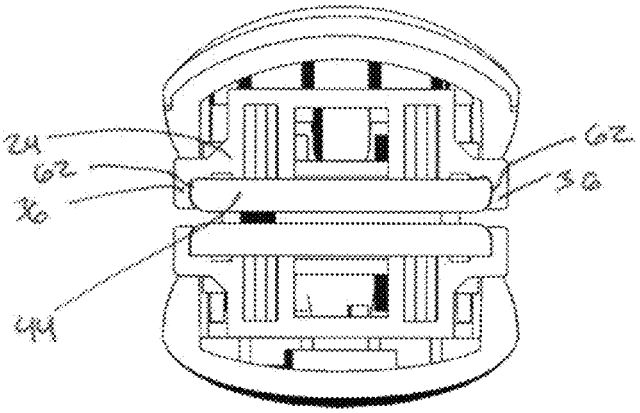
FIG. 14 is a cross-sectional view of a second alternative embodiment of the arm of FIG. 3.
Figure 15:
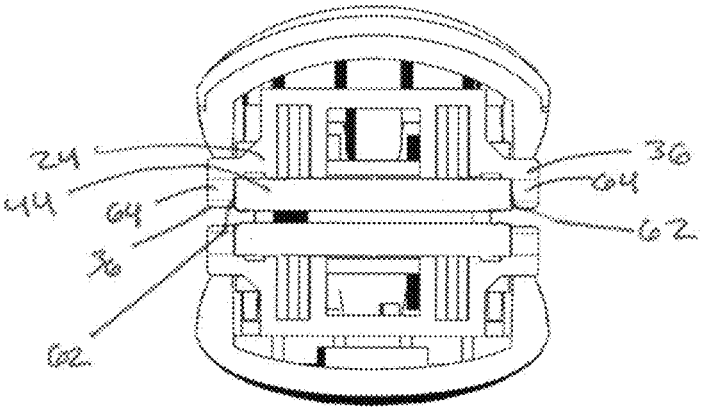
FIG. 15 is a cross-sectional view of a third alternative embodiment of the arm of FIG. 3.

FIGS. 13 and 14 illustrate a pair of contemplated embodiments having a substrate 44 with only one glass pane, and the rails 36 nonetheless wrap over (or cover) at least a portion of the sides 62 to facilitate retaining the substrate 44 on the chassis 24. FIG. 15 illustrates another contemplated embodiment in which the rails 36 do not wrap over the sides 62 of the substrate 44. Rather, the chassis 24 has a separate fastening device (e.g., a plurality of set screws 64) for fastening the sides 62 of the substrate 44 to the rails 36 of the chassis 24 to retain the substrate 44 on the chassis 24.

Figure 16:
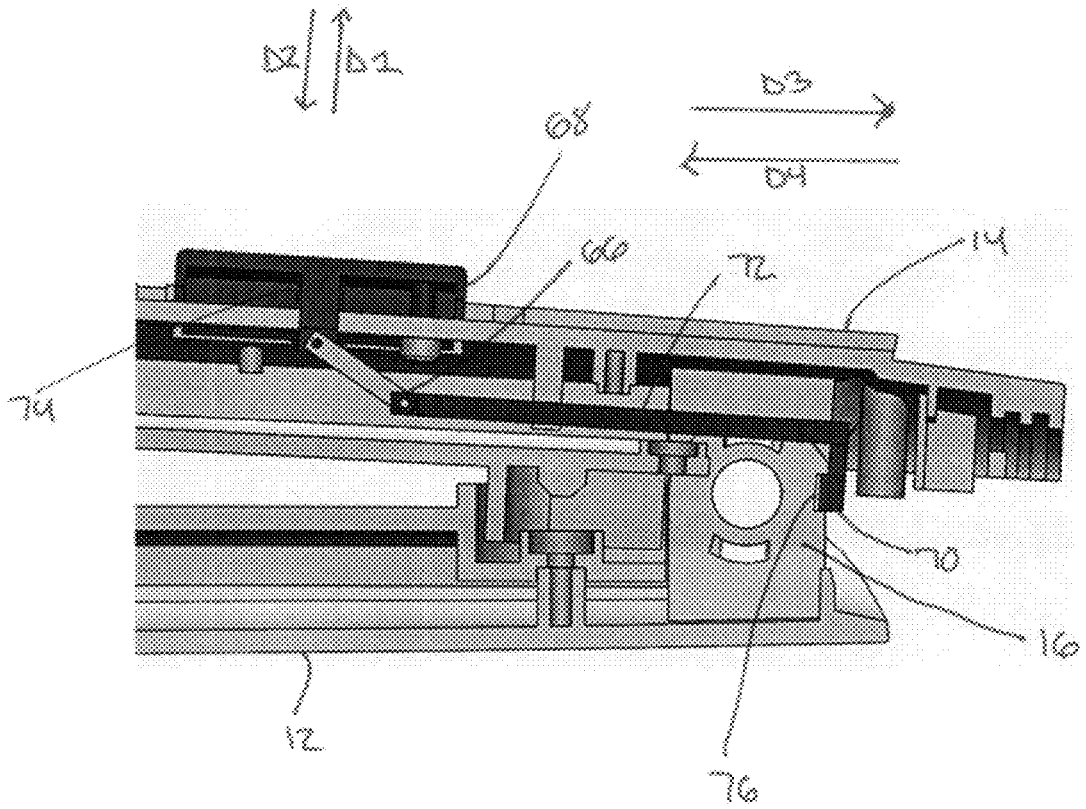
FIG. 16 is a cross-sectional view of a hinge for use in an alternative embodiment of the appliance of FIG. 1.

With reference now to FIG. 16, the straightener 10 may, in other contemplated embodiments, include a locking mechanism 66 for locking the arms 12, 14 in an open position (i.e., the locking mechanism 66 inhibits the arms 12, 14 from closing after having been opened). The locking mechanism 66 may be disposed on the second arm 14 for manual operation by way of a lock button 68. Alternatively, the locking mechanism 66 may be disposed at any suitable location on the straightener 10 (e.g., on the first arm 12), and/or the locking mechanism 66 may be operable by way of a slide or other suitable actuation device as opposed to the lock button 68.

The illustrated lock button 68 is operatively connected to a key 70 via a linkage 72, and the key 70 is configured for engaging the hinge 16 to interfere with the opening and closing motion of the hinge 16. More specifically, the lock button 68 is biased in a direction D1 by a spring 74 such that the linkage 72 and, therefore, the key 70 are biased in a direction D4 for engaging the key 70 with a notch 76 of the hinge 16, thereby interfering with the opening and closing motion of the hinge 16 to effectively lock the hinge 16. However, when a user displaces the lock button 68 in the direction D2 against the bias of the spring 74, the lock button 68 causes movement of the linkage 72 in a direction D3, which in turn causes the key 70 to move in the direction D3, thereby disengaging the key 70 from the notch 76 of the hinge 16 to no longer interfere with the opening and closing motion of the hinge 16, effectively unlocking the hinge 16.

In this manner, when the arms 12, 14 of the straightener 10 are in their open position, and the lock button 68 is not pushed against the bias of the spring 74 in the direction D2, the locking mechanism 66 locks the hinge 16 to retain the arms 12, 14 in the open position. When the user desires to close the arms 12, 14 (e.g., to straighten hair disposed between the heating elements 26), the user manually pushes the lock button 68 in the direction D2 to disengage the key 70 from the notch 76, thereby allowing the full range of motion of the hinge 16 and permitting the arms 12, 14 to be closed.

When the lock button 68 is no longer pushed in the direction D2 by the user, the spring 74 is free decompress and displace the lock button 68 in the direction D1 to automatically engage the key 70 with the notch 76 once the arms 12, 14 have again been opened. By automatically locking the arms 12, 14 in the open position in such a manner, the locking mechanism 66 inhibits inadvertent contact between the heating elements 26 of the arms 12, 14 such as, for example, if the arms 12, 14 were to be forcibly closed (or "clapped" together) when the straightener 10 is not in use. The locking mechanism 66 thereby facilitates preventing damage to the substrates 44 of the heating elements 26. Notably, in other embodiments, the locking mechanism 66 may be configured in any suitable manner that facilitates enabling the locking mechanism 66 to lock the hinge 16 in the open position as described herein.

In some contemplated embodiments, in lieu of (or in addition to) having the locking mechanism 66, the straightener 10 may also include a tethered wristband for tethering the straightener 10 to the user's wrist to facilitate catching the straightener 10 if dropped. Alternatively, in other contemplated embodiments, the straightener 10 may have a pneumatic-type, hold-open (or arm-closer) device disposed between the arms 12, 14 (e.g., a pneumatic piston/cylinder device) to facilitate preventing rapid closing of the arms 12, 14 once opened.

Figure 17:
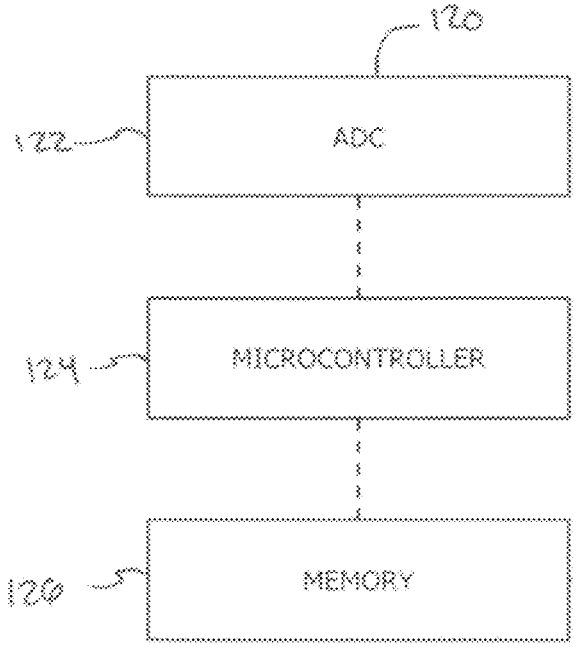
FIG. 17 is a schematic block diagram of a control unit for operating the appliance of FIG. 1.

Referring now to FIG. 17, the control unit 120 (shown in FIG. 4), which is housed within the interior space 32 and is operatively connected to the thermistor 60 (shown schematically in FIG. 9A), comprises an analog-to-digital converter (ADC) 122, a microcontroller 124, and a memory 126 for storing instructions to be executed by the microcontroller 124. The control unit 120 is configured to operate the straightener 10 by controlling the heating element(s) 26 during operation of the straightener 10. In the embodiments described below, the ADC 122 is a 10-bit, 5-volt device. Suitably, other ADC configurations may be used in alternative embodiments.

Figure 18:
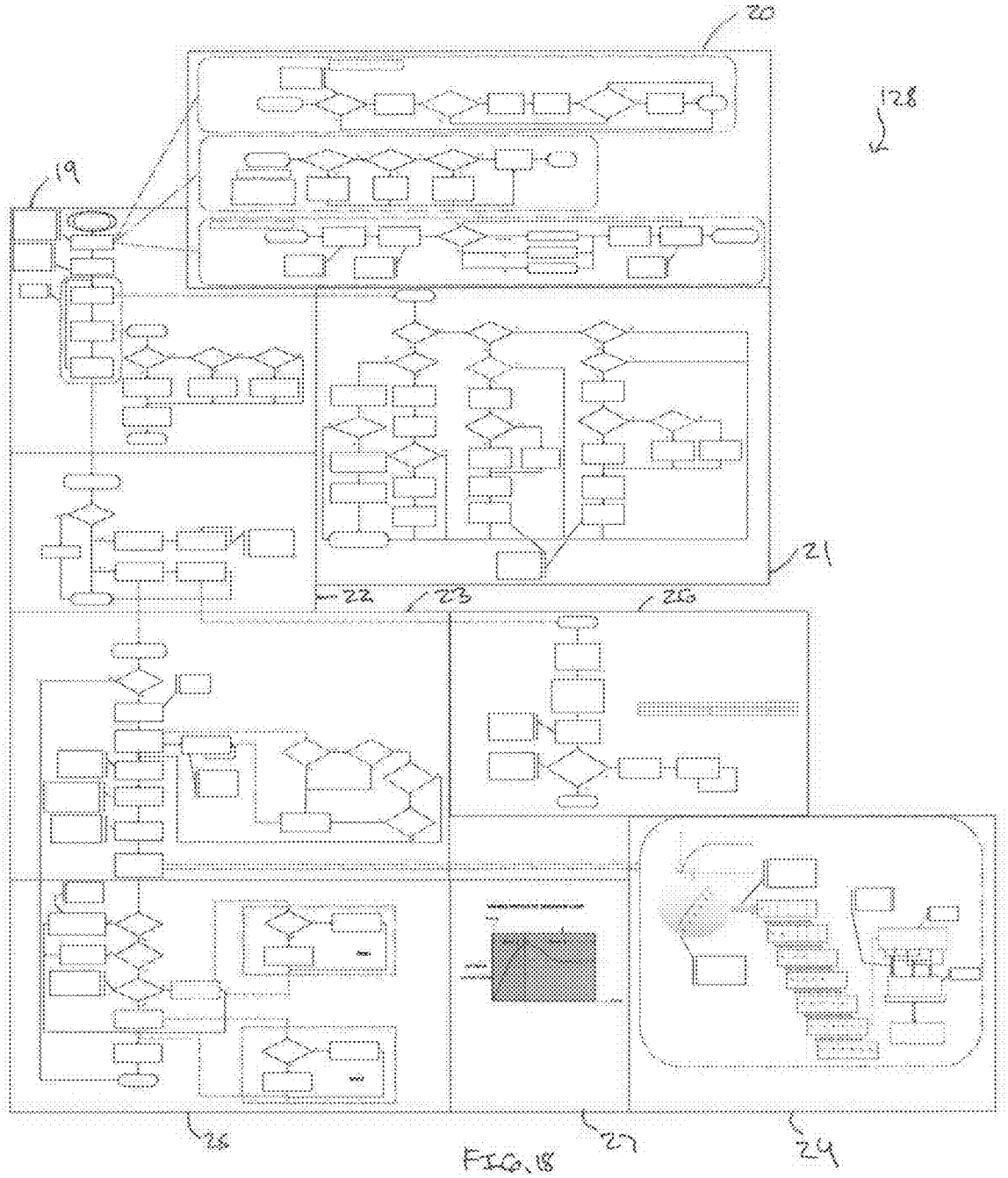
FIG. 18 is a flow chart illustrating an algorithm for use by the control unit of FIG. 17 to operate the heating element of FIG. 8.
Figure 14:
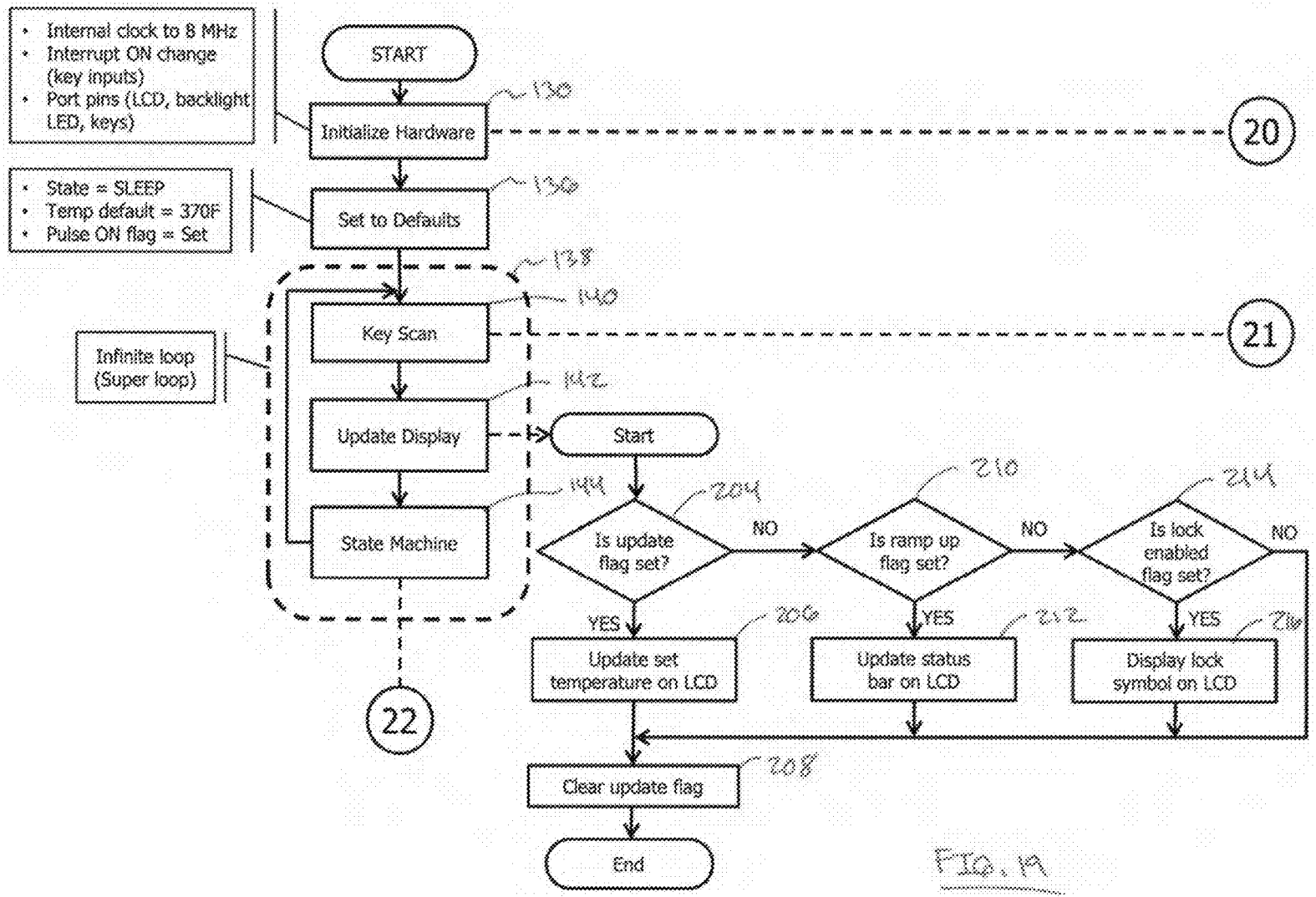
Figure 20:
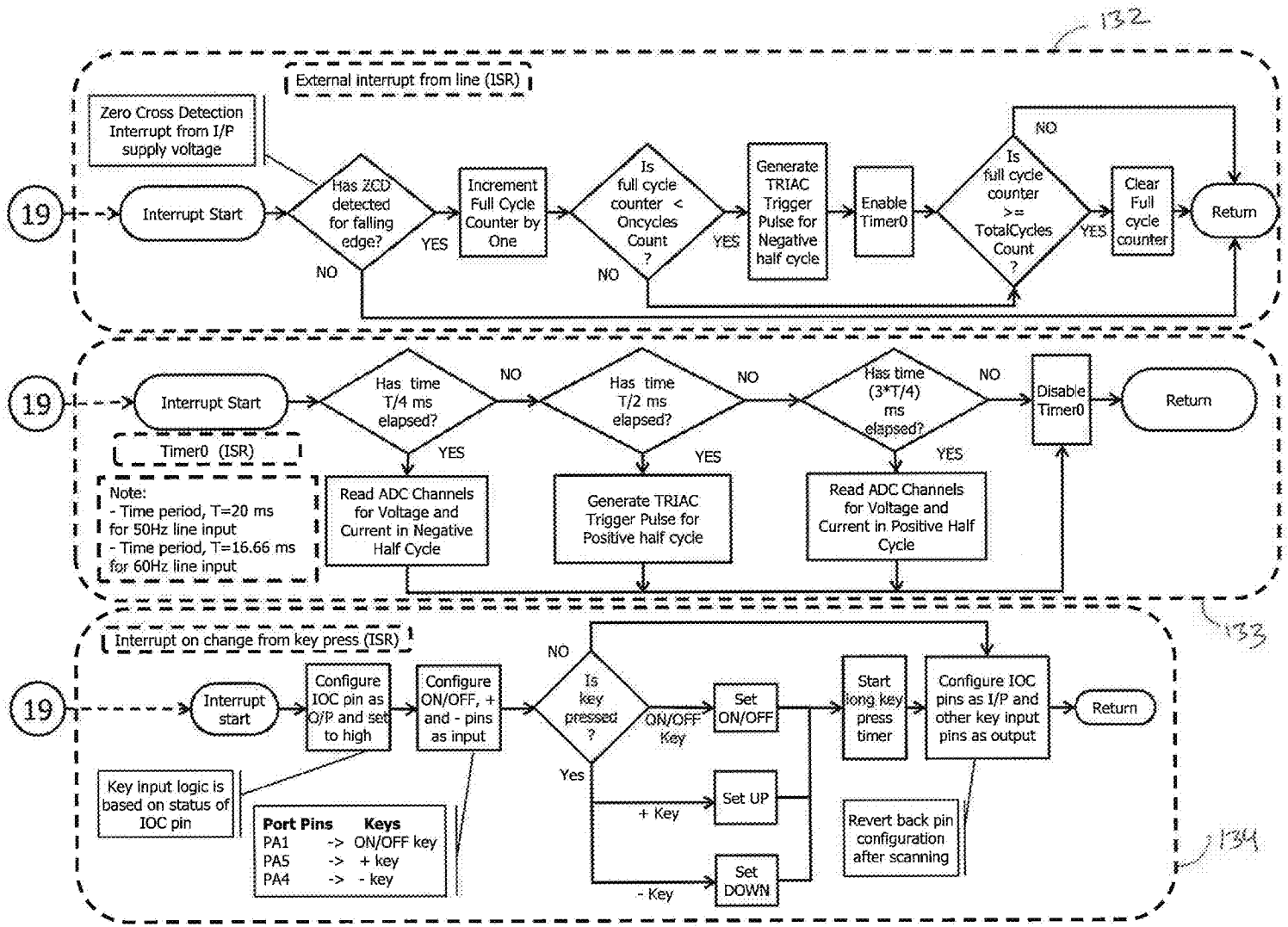
FIG. 20 is another enlarged segment of the flow chart of FIG. 18.

With reference now to the flow chart of FIG. 18, an embodiment of an algorithm 128 is provided for the microcontroller 124 to operate the heating element(s) 26 of the hair straightener 10 using executable instructions stored in the memory 126. FIGS. 19-26 are enlarged views of the various segments of the algorithm 128 shown in FIG. 18. Notably, each segment of FIG. 18 is designated by a reference numeral corresponding to the FIG. 19-26 on which it is enlarged (e.g., the enlarged segment shown in FIG. 19 is designated in FIG. 18 by the reference numeral 19, and the enlarged segment shown in FIG. 20 is designated in FIG. 18 by the reference numeral 20).

Referring first to FIG. 19, when the straightener 10 is powered ON, the microcontroller 124 executes an "initialize hardware" operation 130. For example, the microcontroller 124 will set the internal clock (e.g., the operating frequency of the microcontroller 124 will be set to 8 MHz), the interrupts (e.g., key inputs), and the port pins (e.g., for the keys, the LCD display 84, the backlight LED, etc.). Referring now to FIG. 20, to configure the interrupts, the microcontroller 124 executes an "external interrupt from line (ISR)" operation 132, a "Timer0 (ISR)" operation 133, and an "interrupt on change from key press (ISR)" operation 134.

With reference again to FIG. 19, after ending the "initialize hardware" operation 130, the microcontroller 124 executes a "set to defaults" operation 136. For example, the microcontroller 124 sets the default state of the straightener 10 to a SLEEP state (exiting the SLEEP state when the user short presses the ON/OFF key 78), the default set temperature of the straightener 10 to 370° F., and the Pulse ON setting of the straightener 10.

After ending the "set to defaults" operation 136, the microcontroller 124 begins a super (or infinite) loop 138 of operations that will be continuously executed throughout the operation of the straightener 10. The super loop 138 comprises three consecutively executed operations, namely a "key scan" operation 140 (searching for inputs by the user), an "update display" operation 142 (updating the LCD display 84 to reflect any inputs by the user or changes in the straightener's state of operation), and a "state machine" operation 144 (controlling either the RUN state or SLEEP state of the straightener 10).

Figure 21:
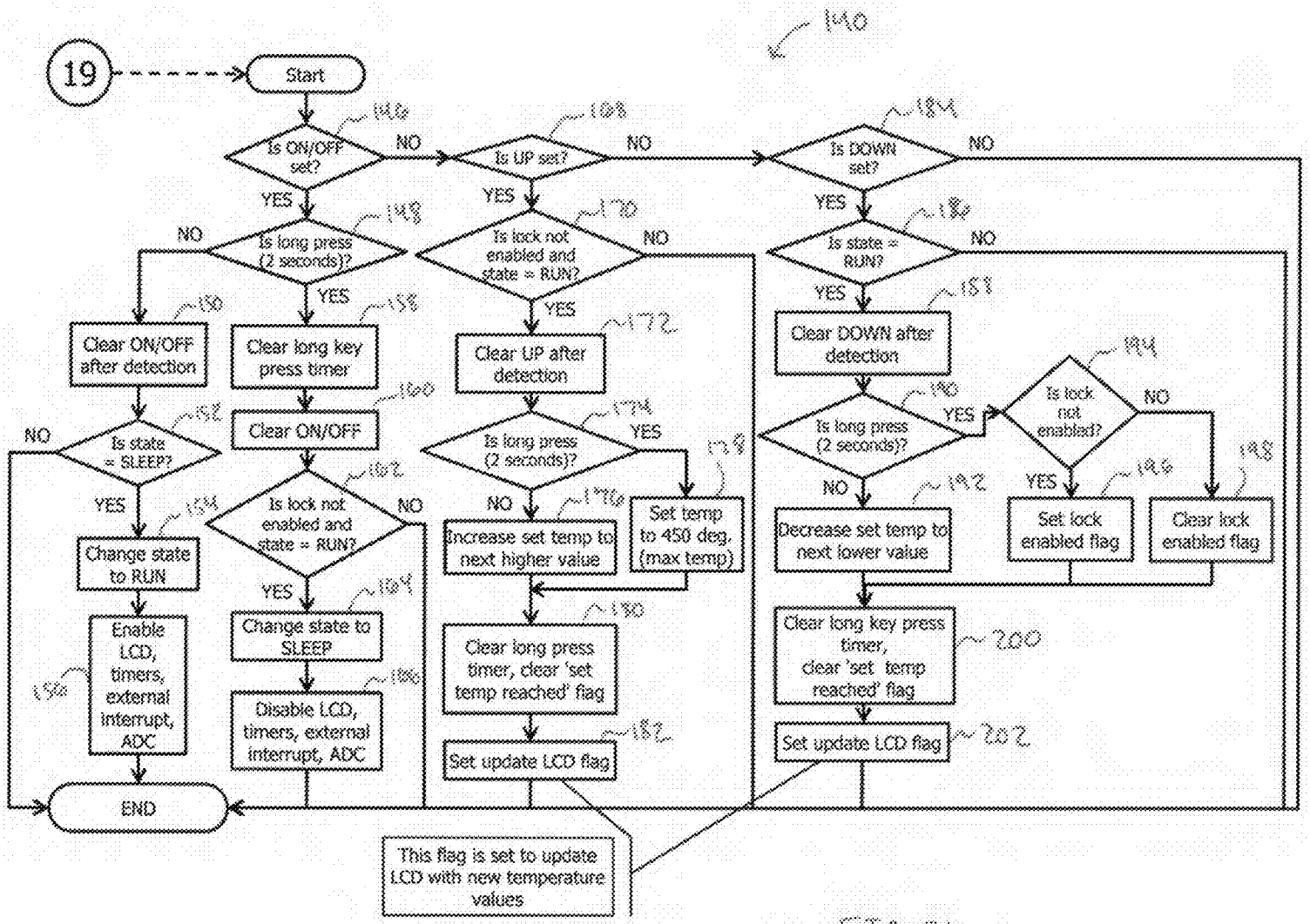
FIG. 21 is another enlarged segment of the flow chart of FIG. 18.

As shown in FIG. 21, to perform the super loop 138, the microcontroller 124 first executes the key scan operation 140 associated with recognizing inputs by the user to the various keys of the straightener 10, namely the ON/OFF key 78, the UP key 80 (for increasing the set temperature), and the DOWN key 82 (for decreasing the set temperature). In the key scan operation 140, the microcontroller 124 first determines 146 whether an input to the ON/OFF key 78 was made by the user. If no input to the ON/OFF key 78 is recognized by the microcontroller 124, the key scan for the ON/OFF key 78 is bypassed. If an input to the ON/OFF key 78 is recognized by the microcontroller 124, the microcontroller 124 determines 148 whether the input was a short key press (less than two seconds) or a long key press (two seconds or more).

If the input is a short key press, the microcontroller 124 then clears 150 the ON/OFF setting and determines 152 whether the current state of the straightener 10 is RUN or SLEEP. If the current state is RUN, then the key scan operation for the ON/OFF key 78 ends. If the current state is SLEEP, then the microcontroller 124 changes 154 the state to RUN, and then enables 156 the LCD display 84, the timers, the external interrupt, and the ADC 122 to make the straightener 10 fully operational before ending the key scan for the ON/OFF key 78.

If the input to the ON/OFF key 78 is a long key press, the microcontroller 124 clears 158 the long key press timer, clears 160 the ON/OFF setting, and determines 162 whether the LOCK is enabled and whether the state is RUN. If the LOCK is enabled or the state is SLEEP, the key scan for the ON/OFF key 78 ends. If the LOCK is not enabled and the state is RUN, the microcontroller 124 changes 164 the state to SLEEP, and disables 166 the LCD display 84, timers, external interrupt, and the ADC 122 to essentially make the straightener 10 non-operational before ending the key scan operation for the ON/OFF key 78.

After bypassing or ending the key scan for an ON/OFF key 78 input and configuring the state of the straightener 10 accordingly, the microcontroller 124 determines 168 whether an input to the UP key 80 was made. If no input to the UP key 80 is recognized by the microcontroller 124, the key scan for the UP key 80 is bypassed. If an input to the UP key 80 is recognized by the microcontroller 124, the microcontroller 124 first determines 170 whether the straightener LOCK is enabled and whether the state is RUN. If the straightener LOCK is enabled or the state is SLEEP, the key scan operation for the UP key 80 ends (since the UP key 80 is only to be operational when the straightener 10 is unlocked in its RUN state). If the straightener LOCK is not enabled and the state is RUN, the microcontroller 124 clears 172 the UP key 80 setting and determines 174 whether the input was a short key press (less than two seconds) or a long key press (two seconds or more). If the key press was short, the microcontroller 124 increases 176 the set temperature incrementally (e.g., by 10° F.). If the key press was long, the microcontroller 124 increases 178 the set temperature to the maximum temperature (e.g., 450° F.). After increasing the set temperature in accordance with the short or long key press, the microcontroller 124 clears 180 the long key press timer and the "set temperature reached" flag, and sets 182 the "update LCD" flag (to later update the LCD display 84 with the new set temperature value) before ending the key scan operation for the UP key 80.

After bypassing or ending the key scan for an UP key 80 input and configuring the state of the straightener 10 accordingly, the microcontroller 124 determines 184 whether an input to the DOWN key 82 was made. If no input to the DOWN key 82 is recognized by the microcontroller 124, the key scan for the DOWN key 82 is bypassed. If an input to the DOWN key 82 is recognized by the microcontroller 124, the microcontroller 124 first determines 186 whether the state of the straightener 10 is RUN. If the state is SLEEP, the key scan operation for the DOWN key 82 ends (since the DOWN key 82 is only to be operational when the straightener 10 is in its RUN state). If the state is RUN, the microcontroller 124 clears 188 the DOWN key 82 setting and determines 190 whether the input was a short key press (less than two seconds) or a long key press (two seconds or more). If the key press was short, the microcontroller 124 decreases 192 the set temperature incrementally (e.g., by 10° F.). If the key press was long, the microcontroller 124 determines 194 whether the LOCK is enabled. If the LOCK is enabled, the microcontroller 124 clears 198 the LOCK enabled flag (i.e., deactivates the LOCK). If the LOCK is not enabled, the microcontroller 124 sets 196 the LOCK enabled flag (i.e., activates the LOCK). After either decreasing the temperature in accordance with a short key press or adjusting the state of the LOCK in accordance with a long key press, the microcontroller 124 clears 200 the long key press timer and (if applicable) the "set temperature reached" flag, and sets 202 the "update LCD" flag (to later update the LCD display 84 with the new set temperature value or LOCK state) before ending the key scan operation for the DOWN key 82.

Referring again to FIG. 19, after ending the key scan operation 140, the microcontroller 124 executes the update display operation 142 by first determining 204 whether the "update" flag has been set. If the update flag has been set, the microcontroller 124 updates 206 the set temperature shown on the LCD display 84 before clearing 208 the update flag and ending the update display operation 142. If the update display flag has not been set, the microcontroller 124 determines 210 whether the "ramp up" flag has been set. If the ramp up flag has been set, the microcontroller 124 updates 212 the status bar on the LCD display 84 accordingly before clearing 208 the update flag and ending the update display operation 142. If the ramp up flag has not been set, the microcontroller 124 determines 214 whether the "LOCK enabled" flag has been set. If the LOCK enabled flag has been set, the microcontroller 124 displays 216 the LOCK symbol on the LCD display 84 before clearing 208 the update flag and ending the update display operation 142. If the LOCK enabled flag has not been set, the microcontroller 124 clears 208 the update flag before ending the update display operation 142.

Figure 22:
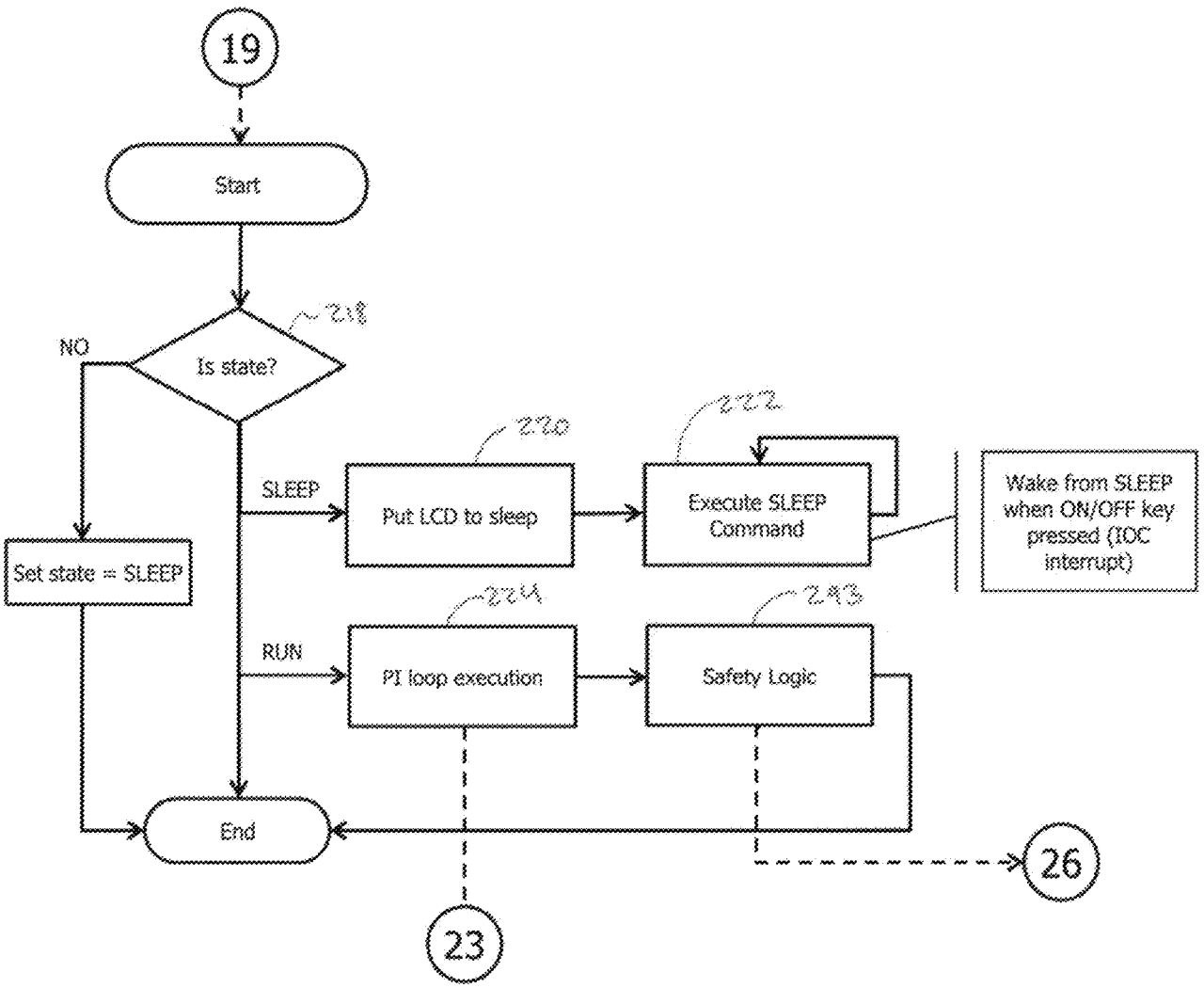
FIG. 22 is another enlarged segment of the flow chart of FIG. 18.

After ending the update display operation 142, the microcontroller 124 executes the state machine operation 144. With reference now to FIG. 22, during the state machine operation 144, the microcontroller 124 first determines 218 whether the state of the straightener 10 has changed from SLEEP to RUN, or from RUN to SLEEP. If the state has changed from RUN to SLEEP, the microcontroller 124 puts 220 the LCD display 84 to sleep and executes 222 the SLEEP command, maintaining the straightener 10 in the SLEEP state permitting the straightener 10 to wake from the SLEEP state only when a short press of the ON/OFF key 78 is detected in the key scan operation 140 (IOC interrupt).

Figure 23:
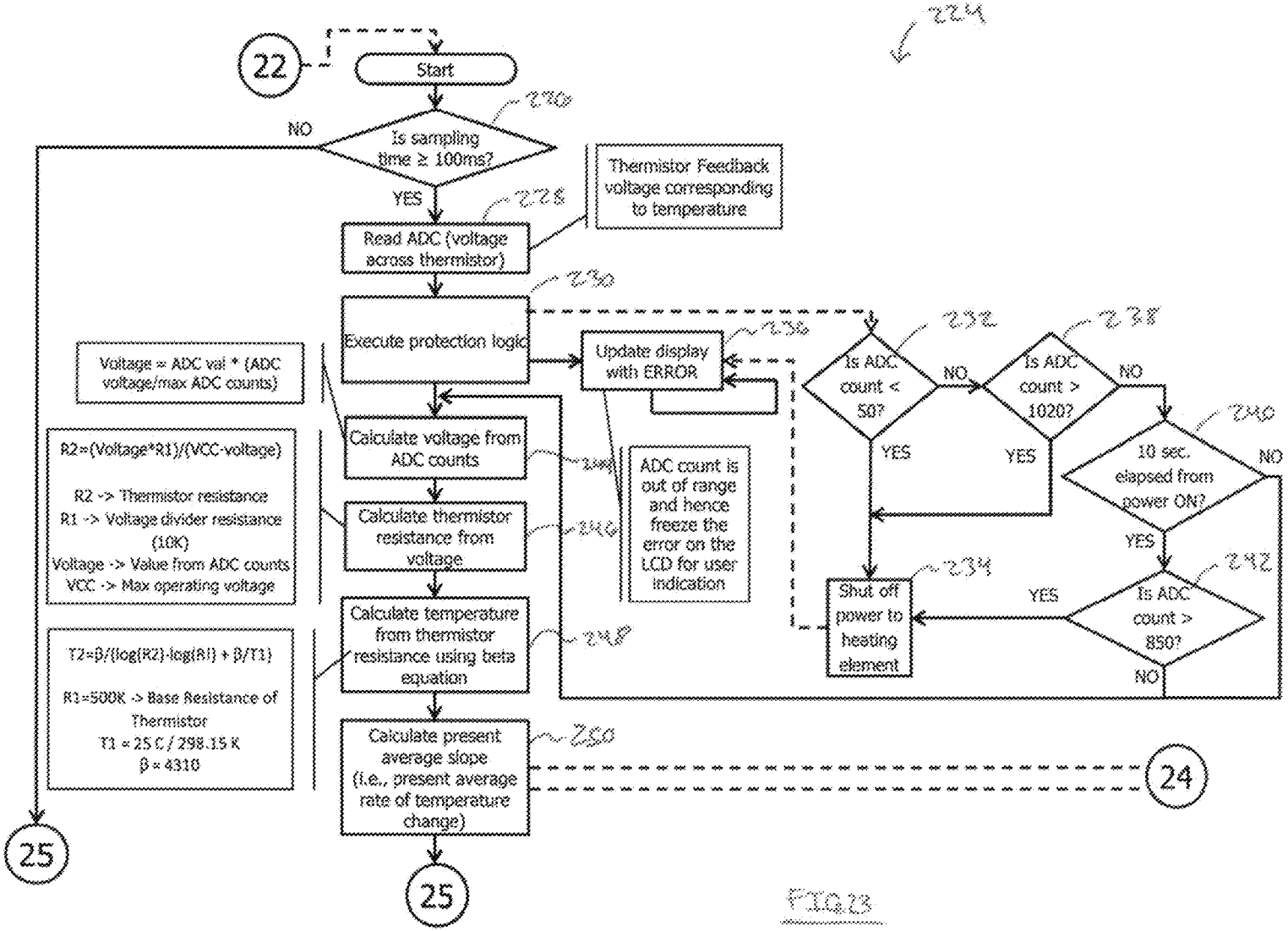
FIG. 23 is another enlarged segment of the flow chart of FIG. 18.
Figure 24:
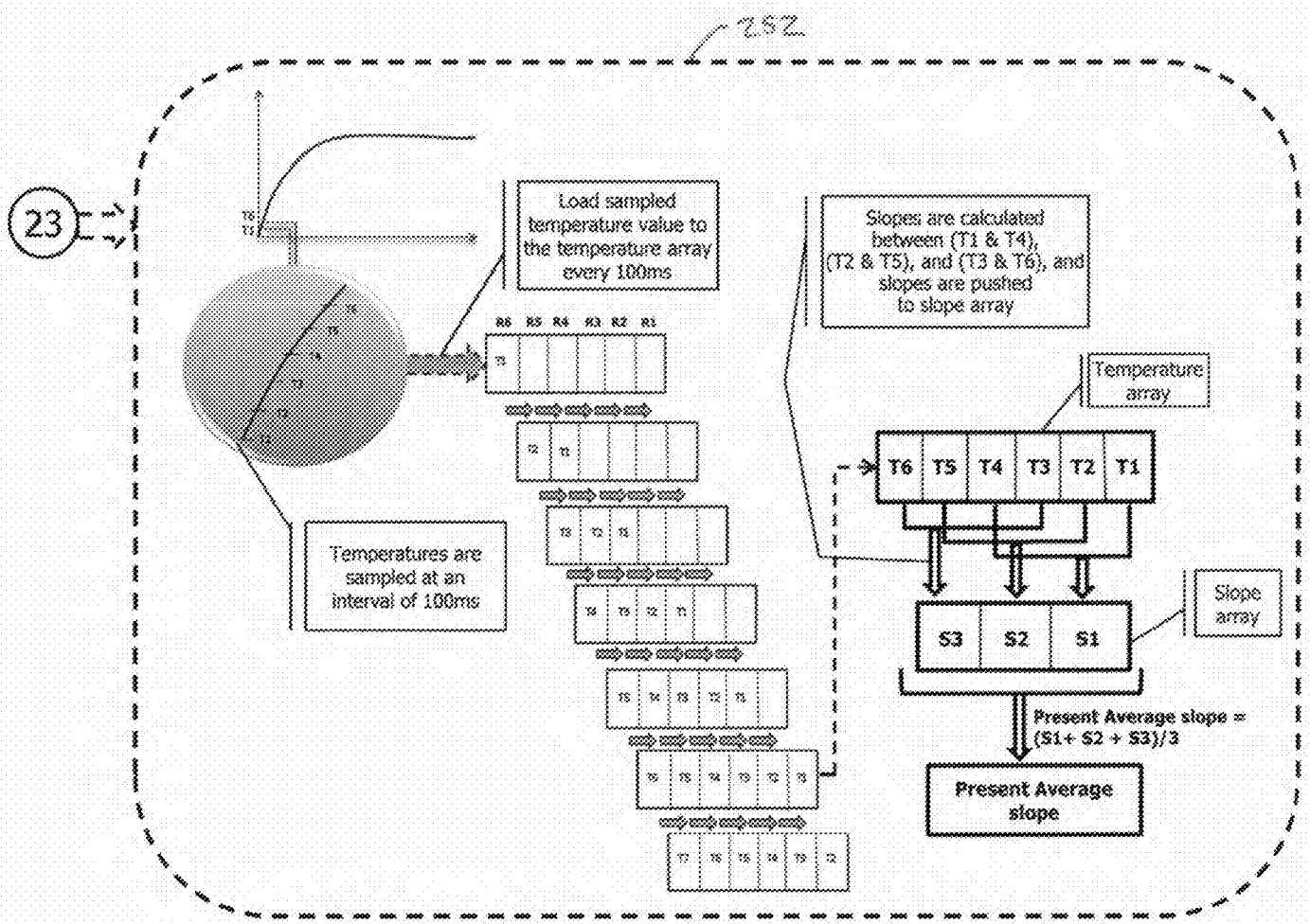
FIG. 24 is another enlarged segment of the flow chart of FIG. 18.

If the state of the straightener 10 has changed from SLEEP to RUN, the microcontroller 124 starts a "PI loop" execution 224, in which the microcontroller 124 controls heating of the straightener 10 in accordance with the set temperature. As shown in FIG. 23, upon initiating the PI loop operation 224, the microcontroller 124 first determines 226 whether it is sampling temperature-related data from the ADC 122 at a rate of at least 100 milliseconds (ms) between samples, with preferably 100 ms elapsing between samples.

This determination facilitates ensuring that the microcontroller 124 is not sampling data from the ADC 122 too quickly.

If the microcontroller 124 determines that less than 100 ms have elapsed since the most recent sample, the microcontroller 124 will end the PI loop execution 224. If the microcontroller 124 determines that 100 ms (or more) have elapsed since the most recent sample, the microcontroller 124 will sample (or read) 228 data from the ADC 122.

After sampling 228 data from the ADC 122, if the sample is the first one taken since the straightener 10 has been powered ON from either a powered OFF state or a SLEEP state, the microcontroller 124 will execute a protection logic operation 230. When executing the protection logic operation 230, the microcontroller 124 first determines 232 whether the sampled ADC count is less than 50. If the sampled ADC count is less than 50, then the microcontroller 124 shuts off 234 power to the heating element(s) 26 and updates 236 the LCD display 84 with an ERROR because an ADC count of less than 50 is an indication that a thermistor 60 is in a short condition and, therefore, is not an accurate gauge for the temperature of its associated heating element 26.

If the sampled ADC count is greater than or equal to 50, then the microcontroller 124 determines 238 whether the ADC count is greater than 1020. If the sampled ADC count is greater than 1020, then the microcontroller 124 shuts off 234 power to the heating element(s) 26 and updates 236 the LCD display 84 with an ERROR. An ADC count of greater than 1020 may indicate that a thermistor 60 is in an open condition and, therefore, is not an accurate gauge for the temperature of its associated heating element 26 (e.g., when a thermistor 60 is at least partially separated from its associated heating element 26, or is otherwise operatively uncoupled from its associated heating element 26, such as when a thermistor 60 or its wiring is malfunctioning).

If the sampled ADC count is less than or equal to 1020, then the microcontroller 124 determines 240 whether 10 seconds have elapsed since power ON. If 10 seconds have not elapsed since power ON, the microcontroller 124 ends the protection logic operation 230 and returns to calculate 244 voltage from the sampled ADC counts (as set forth in more detail below), re-executing the protection logic operation 230 with subsequently sampled ADC counts until the microcontroller 124 determines that 10 seconds have elapsed since power ON.

If 10 seconds have elapsed since power ON, the microcontroller 124 then determines 242 whether the sampled ADC count is greater than 850. If the sampled ADC count is greater than 850, the microcontroller 124 shuts off 234 power to the heating element(s) 26 and updates 236 the LCD display 84 with an ERROR because an ADC count of greater than 850 at 10 or more seconds from power ON may indicate that a thermistor 60 is malfunctioning and, therefore, is not an accurate gauge for the temperature of its associated heating element 26. If the sampled ADC count is less than or equal to 850, then the microcontroller 124 determines that the associated thermistor(s) 60 is operating properly, and the microcontroller 124 ends the protection logic operation 230 and returns to calculate 244 voltage from the sampled ADC count.

Notably, in the illustrated embodiment, the microcontroller 124 will fully execute the protection logic operation 230 only once after power ON, in the sense that the protection logic operation 230 is fully executed only if ended after determining 240 that 10 or more seconds have elapsed since power ON. In other embodiments, however, the protection logic operation 230 may be executed at any suitable time during operation of the straightener 10 in order to test the state of the thermistor(s) 60 (e.g., in some embodiments, the microcontroller 124 may execute the protection logic operation 230 for all ADC data samples throughout an entire operating sequence of the straightener 10, from when the straightener 10 is powered ON to when the straightener 10 is powered OFF or put to SLEEP).

Unless and until the microcontroller 124 shuts off 234 power to the heating element(s) 26 in the protection logic operation 230, the microcontroller 124 calculates 244 a voltage value from each sampled ADC data count, then calculates 246 a resistance value from each voltage value, and then calculates 248 a temperature value (in units of Fahrenheit) from each resistance value using, for example, the equations provided in FIG. 23. Notably, while units of Fahrenheit are used in the illustrated embodiment, other suitable units of temperature may be used in other embodiments without departing from the scope of this invention. Throughout the operation of the straightener 10, as indicated generally by reference numeral 252 in FIG. 24, the microcontroller 124 maintains a moving window (or array) containing its six most recent temperature values, ranked R1 through R6 based upon their recentness (with R1 being the oldest temperature value and R6 being the newest temperature value).

For example, after the microcontroller 124 collects its first six samples from the ADC 122: the first sample's associated temperature value T1 would be ranked R1; the second sample's associated temperature value T2 would be ranked R2; the third sample's associated temperature value T3 would be ranked R3; the fourth sample's associated temperature value T4 would be ranked R4; the fifth sample's associated temperature value T5 would be ranked R5; and the sixth sample's associated temperature value T6 would be ranked R6.

When the microcontroller 124 subsequently obtains a seventh data sample and associated temperature value T7, the first (and now oldest) temperature value T1 is removed from the moving window, meaning that the seventh temperature value T7 is now ranked R6, with the second temperature value T2 now being ranked R1. Then, when the microcontroller 124 ultimately obtains an eighth data sample and associated temperature value T8, the second (and now oldest) temperature value T2 is removed from the moving window, meaning that the eighth temperature value T8 is now ranked R6, with the third temperature value T3 now being ranked R1. As another example, when the microcontroller 124 then obtains a ninth data sample and associated temperature value T9, the third (and now oldest) temperature value T3 is removed from the moving window, meaning that the ninth temperature value T9 is now ranked R6, with the fourth temperature value T4 now being ranked R1.

While maintaining this moving window of temperature values, and after the first six temperature values have been added to the moving window, the microcontroller 124 continuously calculates a present average rate of temperature change (or "present average slope" of the temperature curve in terms of a temperature over time plot). To calculate the present average slope using the six most recent temperature values, the microcontroller 124 determines three different slope values, namely a first slope value S1 (using R4 and R1 ranked temperature values); a second slope value S2 (using R5 and R2 ranked temperature values); and a third slope value S3 (using R6 and R3 ranked temperature values).

By averaging the three slope values S1, S2, S3, the microcontroller 124 is able to determine a present average slope or, in other words, a present average rate of temperature change for the heating element(s) 26. In that regard, the microcontroller 124 continuously logs the present average slope value and the previous present average slope value. For example, upon calculating the present average slope value using the seventh temperature value T7 (i.e., the present average slope value based on temperature values T2-T7), the previous present average slope value would have previously been calculated based on temperature values T1-T6. Likewise, upon calculating the present average slope value using the eighth temperature value T8 (i.e., the present average slope value based on temperature values T3-T8), the previous present average slope value would have previously been calculated based on temperature values T2-T7. In sum, the microcontroller 124 is adjusting the moving window of temperature values, calculating a new present average slope value, and logging a previous present average slope value every 100 ms.

Figure 25:
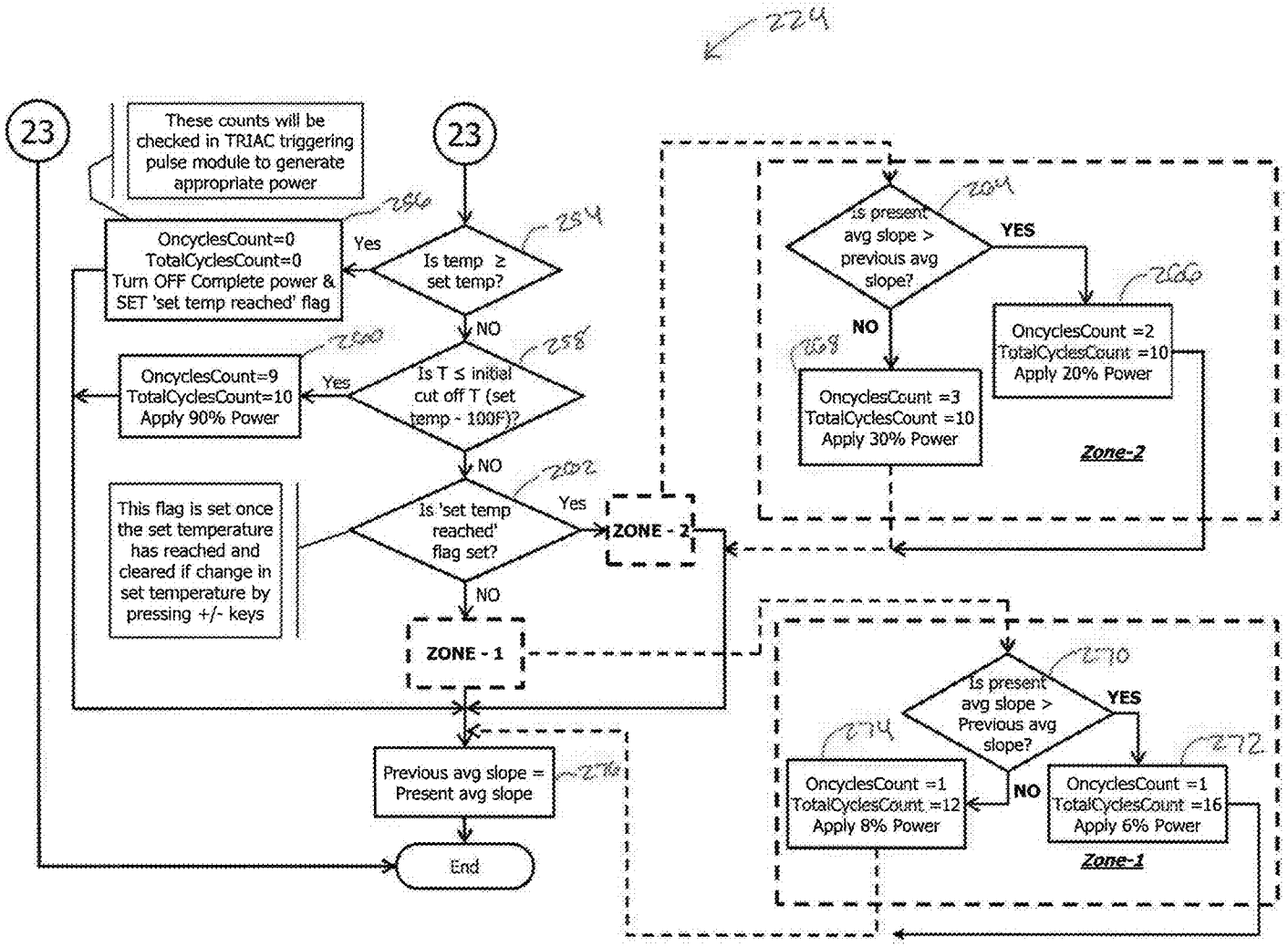
FIG. 25 is another enlarged segment of the flow chart of FIG. 18.
Figure 20:
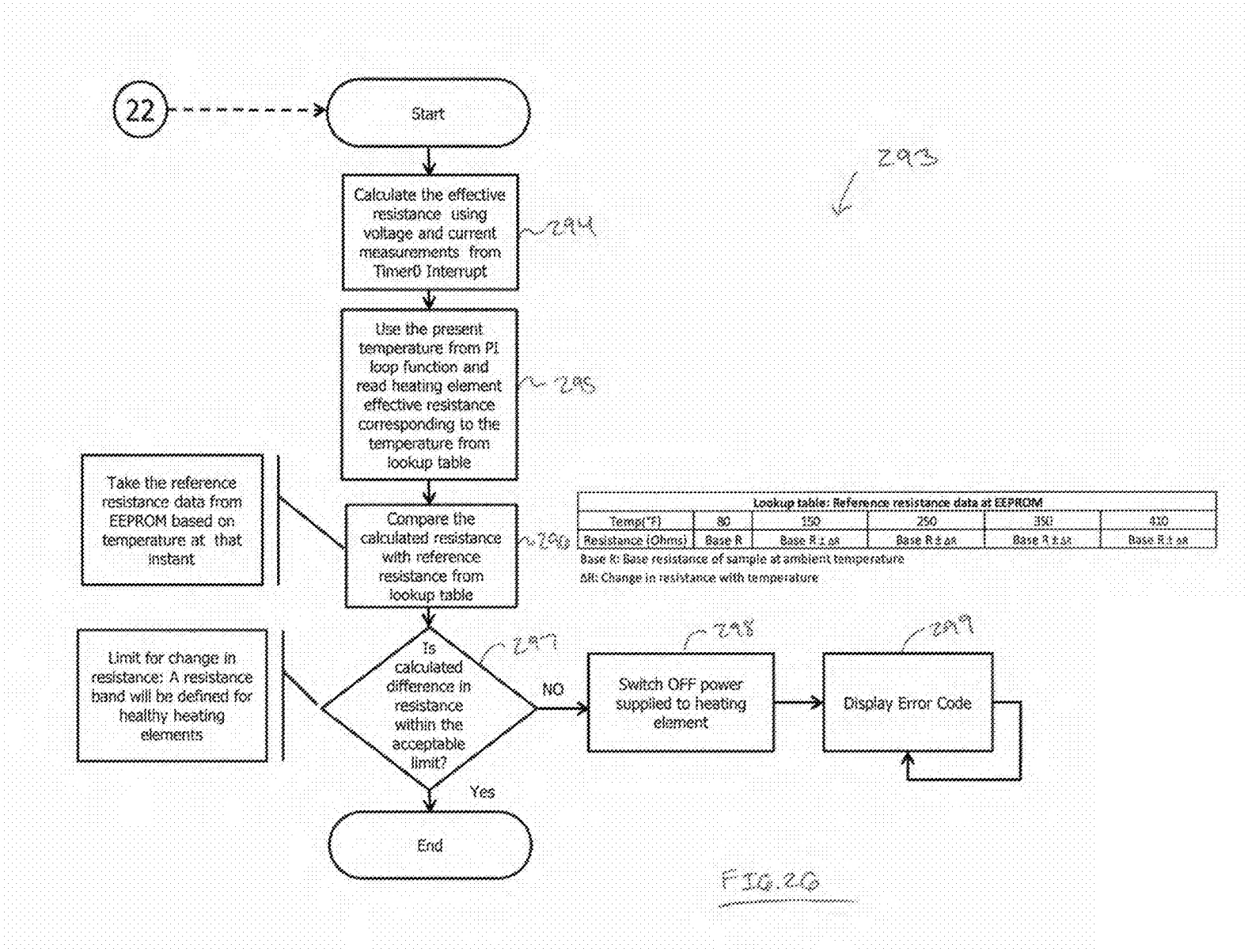

Referring now to FIG. 25, once the microcontroller 124 calculates the seventh temperature value T7 (e.g., after about 700 milliseconds of operation time in terms of ADC sampling rate), the microcontroller 124 then determines 254, for the seventh temperature value T7 and each subsequent temperature value, whether the temperature value is greater than or equal to the set temperature value.

Notably, in the illustrated embodiment, the microcontroller 124 defaults the set temperature value to 370° F. when the straightener 10 is powered ON (either from a powered OFF state or a SLEEP state). During operation of the straightener 10, the user has the ability to adjust the set temperature value by increments of 10° F. using the UP and DOWN keys 80, 82 (as set forth above). However, the user is limited to adjusting the set temperature within the range of 300° F. to 450° F. in this embodiment. In other embodiments, any suitable increment(s) and/or range(s) of temperature adjustment may be used without departing from the scope of this invention.

If the microcontroller 124 determines 254 that a temperature value is greater than or equal to the set temperature value, the microcontroller 124 turns off 256 power to the heating element(s) 26 and sets the "set temperature reached" flag before updating 276 the present average slope value, discarding the previous present average slope value and ending the PI loop operation 224.

If, on the other hand, the microcontroller 124 determines 254 that a temperature value is less than the set temperature value, the microcontroller 124 then determines 258 whether the temperature value is less than or equal to the "initial cut off temperature value," which is defined as being 100° F. less than the set temperature value. For example, if the set temperature value is 300° F., then the initial cut off temperature value is 200° F. Similarly, if the user adjusts the set temperature value to 400° F., then the initial cut off temperature value is likewise adjusted to 300° F. In other words, the initial cut off temperature value is adjusted along with the set temperature value.

If the microcontroller 124 determines 258 that the temperature value is less than or equal to the initial cut off temperature value, then the microcontroller 124 decides 260 to apply 90% power to the heating element(s) 26 before updating 276 the present average slope value, discarding the previous present average slope value, and ending the PI loop operation 224. However, if the microcontroller 124 determines 258 that the temperature value is greater than the initial cut off temperature value, then the microcontroller 124 determines 262 whether the "set temperature reached" flag is set (i.e., whether a prior temperature value had reached the set temperature value and, therefore, caused the set temperature reached flag to be set).

If the set temperature reached flag is not set, then the microcontroller 124 decides to apply "zone 1" power to the heating element(s) 26. Specifically, the microcontroller 124 identifies the present average slope (which the microcontroller 124 is constantly updating) and determines 270 whether the present average slope is greater than the previous present average slope. If the present average slope is greater than the previous present average slope, the microcontroller 124 decides to apply 272 6% power to the heating element(s) 26. However, if the present average slope is not greater than the previous present average slope, the microcontroller 124 decides to apply 274 8% power to the heating element(s) 26. After deciding whether to apply 6% or 8% power to the heating element(s) 26, the microcontroller 124 then updates 276 the present average slope value and discards the previous present average slope value before ending the PI loop operation 224.

If, on the other hand, the microcontroller 124 determines 262 that the set temperature reached flag is set, then the microcontroller 124 decides to apply "zone 2" power to the heating element(s) 26. Specifically, the microcontroller 124 identifies the present average slope (which the microcontroller 124 is constantly updating) and determines 264 whether the present average slope is greater than the previous present average slope. If the present average slope is greater than the previous present average slope, the microcontroller 124 decides to apply 266 20% power to the heating element(s) 26. However, if the present average slope is not greater than the previous present average slope, the microcontroller 124 decides to apply 268 30% power to the heating element(s) 26. After deciding whether to apply 20% or 30% power to the heating element(s) 26, the microcontroller 124 then updates 276 the present average slope value and discards the previous present average slope value before ending the PI loop operation 224.

Referring back to FIG. 22, after ending the PI loop operation 224, the microcontroller 124 then executes 293 a safety logic function to ensure that the heating element(s) 26 are operating at an appropriate level of resistance to current flow through the electrically conductive material 46. More specifically, by executing 293 the safety logic function every 100 ms, the microcontroller 124 is essentially able to monitor, in real-time, the resistance of the heating element(s) 26 and shut off power to the heating element(s) 26 if the resistance falls outside of an acceptable range.

As shown in FIG. 26, to execute 293 the safety logic function, the microcontroller 124 first calculates 294 an effective resistance using voltage and current measurements from a Timer0 interrupt, before using 295 the present temperature from the PI loop function and reading the heating element effective resistance corresponding to the temperature from a lookup table A-A. The microcontroller 124 then proceeds to compare 296 the calculated resistance with a reference resistance from the lookup table A-A before determining 297 if the calculated difference in resistance is within an acceptable limit. If so, then the microcontroller 124 ends the safety logic function. If not, then the microcontroller 124 switches 298 OFF power supplied to the heating element(s) 26 before proceeding to display 299 an error code on the LCD display 84.

Referring back to FIG. 22, after proceeding to execute 293 the safety logic function, the microcontroller 124 ends the state machine operation 144. As shown in FIG. 19, the microprocessor 124 then reenters the super loop 138 in order to execute another key scan operation 140, update display operation 142, and state machine operation 144. In this manner, the super loop 138 continuously repeats and, as such, the PI loop operation 224 repeats about every 100 ms.

Using the above-described heating elements 26 and control unit 120 for operating the heating elements 26, the straightener 10 is configured to heat up from room temperature (e.g., 70° F.) to a set temperature (e.g., a default set temperature of 370° F.) in less than a minute while mitigating leakage current associated with such rapid heating. As used herein, the term "leakage current" refers to electrical current that, as it flows along the electrically conductive material 46 of each heating element 26, is transmitted to the substrate 44 of that heating element 26 and potentially to the user.

Set forth below is an example of a heat-up operation of one of the heating elements 26 of the straightener 10 using the algorithm 128. In this example, the microcontroller 124 is described as performing the algorithm 128 to heat the heating element 26 of the second arm 14, but it should be noted that the microcontroller 124 may also be simultaneously and separately performing the algorithm 128 on the heating element 26 of the first arm 12 as well. In other words, while the straightener 10 is described in the examples below as having one control unit 120 for operating each heating element 26 (e.g., two control units 120 per straightener 10), it is contemplated that in alternative embodiments the straightener 10 may suitably have the heating elements 26 of both arms 12, 14 being operated by a single control unit 120 disposed in either one of the arms 12, 14 (e.g., one control unit 120 per straightener 10).

When the user powers the straightener 10 ON (from either a powered OFF state or a SLEEP state) using the ON/OFF key 78, the microcontroller 124 first initializes 130 the hardware and sets 136 the defaults (e.g., makes the set temperature 370° F. in this example). The microcontroller 124 then enters the super loop 138 and performs a key scan operation 140. If the user has since not pressed any keys (e.g., the UP key 80 or the DOWN key 82), the microcontroller 124 ends the key scan operation 140 and performs the update display operation 142 to indicate to the user that the temperature of the straightener 10 is ramping up.

After performing the update display operation 142, the microcontroller 124 executes the state machine operation 144, in which the microcontroller 124 determines 218 that the state is RUN and begins to execute 224 the PI loop. When executing 224 the PI loop, the microcontroller 124 first determines 226 that 100 milliseconds (ms) have elapsed since the last ADC sampling event (given that this is the first pass through the PI loop since the straightener 10 was powered ON). The microcontroller 124 then samples 228 data from the ADC 122 (i.e., the microcontroller 124 reads a first ADC count), and executes 230 the protection logic using the first ADC count. When executing 230 the protection logic, the microcontroller 124 determines 232 that the first ADC count is not less than 50, and determines 238 that the first ADC count is not greater than 1020. The microcontroller 124 then determines 240, however, that 10 seconds have not elapsed since power ON, and the microcontroller 124 stops executing 230 the protection logic.

Nevertheless, despite not having fully executed 230 the protection logic using the first ADC count, the microcontroller 124 proceeds with calculating 244 the voltage value associated with the first ADC count, calculating 246 the associated resistance value using the calculated voltage value, and calculating 248 a first temperature value T1 using the calculated resistance value. Having obtained the first temperature value T1, the microcontroller 124 then calculates 250 the present average slope value which, with only one stored temperature value in the form of T1, is zero. The microcontroller 124 also stores the first temperature value T1 in the moving window as rank R1.

The microcontroller 124 then proceeds to determine 254 that the first temperature value T1 is not greater than or equal to the set temperature, and subsequently determines 258 that the first temperature value T1 is less than or equal to the initial cut off temperature value (e.g., 270° F. in this example, which is the difference of 370° F.-100° F. in the embodiment where the default set temperature is 370° F.). As such, the microcontroller 124 ultimately decides 260 to apply 90% power to the associated heating element 26, and the microcontroller 124 then sets 276 the present average slope value to zero before ending the PI loop execution 224. After ending the PI loop execution 224, the microcontroller 124 executes 293 the safety logic and ends the state machine execution 144 before looping back to the key scan operation 140 within the super loop 138.

Notably, with each subsequent pass through the super loop 138, the microcontroller 124 will again attempt to execute 230 the protection logic with each subsequent ADC sample until the protection logic is able to be fully executed, which should occur around the 100th sampling of the ADC 122 (i.e., after about 10 seconds at an ADC sampling rate of 100 milliseconds). Once the microcontroller 124 ultimately determines 240 that 10 seconds have elapsed since power ON and determines 242 that an ADC count is not greater than 850, the protection logic will then be fully executed for the one and only time until the straightener 10 is again powered ON after having been powered OFF or put to SLEEP.

Moreover, with each subsequent pass through the super loop 138 (i.e., for each temperature value calculated after T1), the microcontroller 124 decides to apply 90% power to the heating element 26, until the microcontroller 124 determines 258 that the calculated temperature value T350, for example, is greater than the initial cut-off temperature of 270° F. Once the microcontroller 124 determines 258 that temperature value T350 is greater than the initial cut-off temperature, the microcontroller 124 then determines 262 that the "set temperature reached" flag has not been set (i.e., that the temperature value T350 is, and prior temperature values have been, less than the set temperature of 370°). As a result, the microcontroller 124 decides to apply "zone 1" power to the heating element 26. In that regard, because the microcontroller 124 then determines 270 that the present average slope is greater than the previous present average slope, the microcontroller 124 decides 272 to apply 6% power to the heating element 26 in response to the calculated temperature value T350. The microcontroller 124 then updates 276 the present average slope value and discards the previous present average slope value before ending the PI loop execution 224.

After ending the PI loop execution 224, the microcontroller 124 executes 293 the safety logic function and ends the state machine operation 144 before looping back to the key scan operation 140 for another pass through the super loop 138. As a result, the microcontroller 124 executes 140 another key scan operation to determine whether any keys have been pressed by the user since the previous key scan operation was executed (i.e., whether the user has increased or decreased the set temperature using the UP key 80 or the down key 82). Having determined that no keys have since been pressed, the microcontroller 124 ends the key scan operation and proceeds to update 142 the LCD display 84 (e.g., indicating to the user that the temperature of the heating element 26 is the temperature value T350). The microcontroller 124 then ends the update display operation 142 and executes 144 the state machine operation 144 again, in which the microcontroller 124 again executes 224 the PI loop operation.

Notably, after completing its 350th pass through the super loop 138 in this example, the microcontroller 124 continues to apply "zone 1" power (i.e., either 6% power or 8% power, depending upon the change in slope) for subsequent passes through the super loop 138. Essentially, the algorithm 128 is configured such that, a larger amount of power (i.e., 90%) is provided to the heating element 26 until it is determined that the temperature of the heating element 26 is approaching (i.e., coming within 100° of) the set temperature, at which time the power to the heating element 26 is scaled down to "zone 1" power (i.e., either 6% or 8% power) to facilitate minimizing potential overshoot of the set temperature.

Once the microcontroller 124 later determines 254 that the calculated temperature value T500 is greater than the set temperature, the microcontroller 124 cuts 256 power to the heating element 26 and sets the "set temperature reached" flag. Notably, the set temperature of 370° F. was reached within about 50 seconds from power ON (i.e., at the 500th pass through the super loop 138) in this example, where each pass takes about 100 ms to complete. The goal of the microcontroller 124 is now to maintain the set temperature of 370° throughout operation of the straightener 10 unless and until the set temperature is changed by the user, as set forth in more detail below.

In its effort to maintain the set temperature and in its 525th pass through the super loop 138, for example, the microcontroller 124 then calculates 248 temperature value T525. The microcontroller 124 subsequently determines 254 that the temperature value T525 is below the set temperature (which occurred by virtue of power having been cut 256 to the heating element 26 from passes 500-524 of the super loop 138), and also determines 258 that the temperature value T525 is above the initial cut off temperature. Then, the microcontroller 124 determines 262 that the "set temperature reached" flag has been set (by virtue of temperature value T500). As a result, the microcontroller 124 now decides to apply "zone 2" power to the heating element 26.

Because the microcontroller 124 now determines 264 that the present average slope is greater than the previous present average slope, the microcontroller 124 decides 266 to apply 20% power to the heating element 26 in response to the calculated temperature value T525. The microcontroller 124 then updates 276 the present average slope value and discards the previous present average slope value before ending the PI loop operation 224 and executing 293 the safety logic function.

For each pass through the super loop 138 after having calculated temperature value T525, the microcontroller 124 continues to determine 262 that the "set temperature reached" flag has been set, until the set temperature is reset (if at all) by the user using the UP key 80 or the down key 82. In this manner, unless the set temperature is reset by the user, the microcontroller 124 continues to apply "zone 2" power to the heating element 26, effectively modulating power to the heating element 26 between 20% power and 30% power as appropriate depending upon the determination 264 as to whether the present average slope is greater than the previous present average slope.

In sum, once the set temperature has first been reached and the flag set, the microcontroller 124 cuts power to the heating element 26 and waits for the temperature of the heating element 26 to fall below the set temperature. Then, the microcontroller 124 again provides power to the heating element 26 and begins to modulate the power to the heating element 26 using "zone 2" power to essentially maintain the temperature close to the set temperature for the duration of operation or until the set temperature is changed.

Thus, using the above-described algorithm, the microcontroller 124 is better able to determine (in almost real-time) the appropriate amount of power that should be provided to the heating element 26 in order to achieve the desired temperature of the heating element 26 (i.e., the microcontroller 124 is able to determine whether 6% power, 8% power, 20% power, 30% power, or 90% power is most appropriate). As such, the microcontroller 124 is able to step up and step down the power provided to the heating element 26 in a manner that reduces the prospect of providing the heating element 26 with more power than is needed to reach the set temperature, given that excessive power provided to the heating element 26 can result in undesirable leakage current.

Notably, if after the heating element 26 has been fully heated (i.e., heated to the set temperature) and the "set temperature reached" flag has been set, the user adjusts the set temperature using the UP key 80 or the down key 82, the microcontroller 124 will initially respond in the manner of the following examples.

If the set temperature is raised by more than 100° F. after the heating element 26 has already been fully heated, the microcontroller 124 will in its subsequent pass through the super loop 138 determine 254 that the calculated temperature value is not greater than or equal to the new set temperature, and then determine 258 that the calculated temperature value is less than the initial cut-off temperature. As such, the microcontroller 124 will initially apply 260 90% power to the heating element 26 as a result of such a change in the set temperature by the user.

Along these lines, in the event that the user raises the set temperature by less than 100° F. after the heating element 26 has been fully heated, the microcontroller 124 will in its subsequent pass through the super loop 138 determine 254 that the calculated temperature value is not greater than or equal to the new set temperature, and then determine 258 that the calculated temperature value is greater than the initial cut-off temperature. Next, the microcontroller 124 will determine 262 that the "set temperature reached" flag has not been set (i.e., that the temperature has not yet reached the newly changed set temperature), and the microcontroller 124 will then decide to apply "zone 1" power to the heating element 26.

In a different example, if the user lowers the set temperature after the heating element 26 has been fully heated, the microcontroller 124 will in its subsequent pass through the super loop 138 determine 254 that the calculated temperature is greater than the new set temperature, and the microcontroller 124 will then decide to apply 256 no power to the heating element 26. To play this example out further, in a subsequent pass through the super loop 138, the microcontroller 124 will ultimately determine 254 that the temperature of the heating element 26 is not greater than or equal to the new set temperature (i.e., when the temperature of the heating element 26 has fallen below the new set temperature), at which point the microcontroller 124 determines 258 that the temperature of the heating element 26 is not less than or equal to the initial cut off temperature. As a result, the microcontroller 124 then determines 262 that the "set temperature reached" flag has been set (by virtue of the temperature of the heating element 26 lowering below the new set temperature), and the microcontroller 124 will then determine that "zone 2" power should be applied.

The above-described methods for powering the heating element(s) 26 facilitate minimizing any overshoot (or oversupply of current) to the heating element(s) 26. This, in turn, facilitates minimizing any leakage current that could result from excessively powering the heating element 26.

Figure 27:
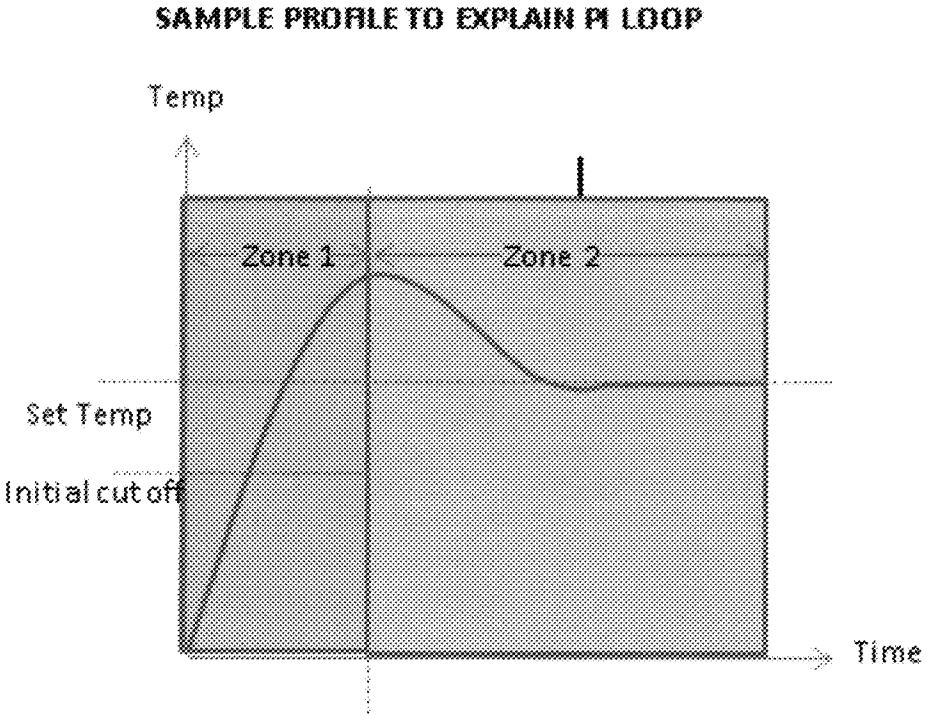
FIG. 27 is a graphical representation of a heat profile of the heating element of FIG. 8 when heated using the algorithm of FIG. 18.
Figure 28:
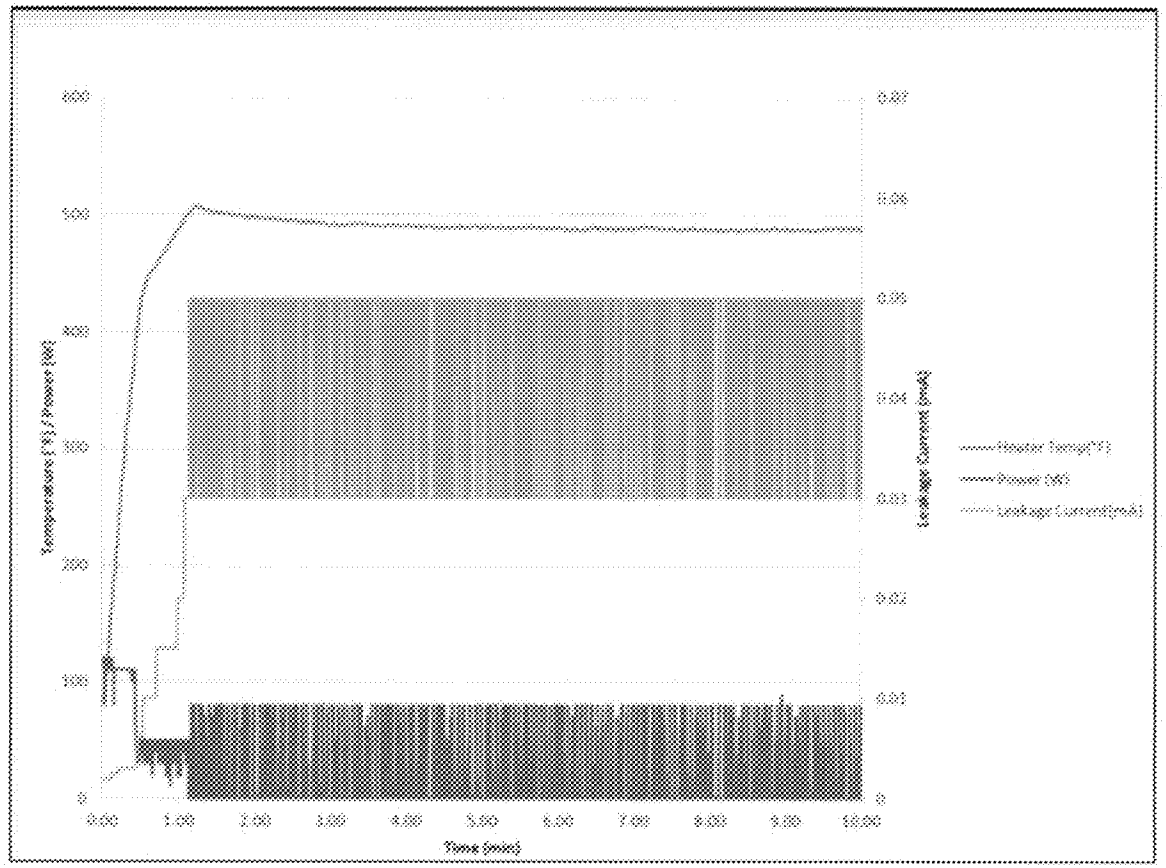
FIG. 28 is a graphical representation of various parameters of the heating element of FIG. 8 when heated using the algorithm of FIG. 18.

With reference now to FIGS. 27 and 28, FIG. 27 is a graphical representation of a heat profile of the straightener 10 during operation using the algorithm 128, and the heat profile is shown in terms of a temperature over time plot. Notably, once the temperature of the heating element 26 has reached the set temperature, "zone 2" heating begins shortly thereafter due to the short time delay of the microcontroller 124 making another pass though the super loop 138. FIG. 28 is a graphical representation of temperature, power, and leakage current parameters (plotted over time) of a straightener configured similarly to the straightener 10 (but with a set temperature of 500° F.) when using the algorithm 128. Notably, during power-up, once the set temperature of the heating element 26 has been reached (i.e., once the temperature curve begins to level off on the graph), the microcontroller 124 modulates the applied power to maintain such a temperature, and the leakage current modulates around a desirable leakage current value as a result.

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A heated appliance comprising:

a pair of arms; and a hinge attaching the arms together such that the arms are openable and closeable relative to one another via the hinge, wherein each of the arms comprises a heating element having a multi-pane glass substrate and an electrically conductive material deposited on the glass substrate, wherein each multi-pane glass substrate has a stacked configuration in which each pane of the multi-pane glass substrate is in a different plane.

2. The heated appliance of claim 1 wherein the electrically conductive material is a metal oxide material.

3. The heated appliance of claim 1 wherein the glass substrate has only one of the panes made from a treated glass material.

4. The heated appliance of claim 1 wherein the heating element has a pair of sides, and wherein each of the arms comprises a chassis configured for wrapping over at least a portion of the sides of the associated heating element.

5. The heated appliance of claim 4 wherein the chassis comprises a pair of rails that define a pair of channels sized to receive the sides of the associated heating element.

6. The heated appliance of claim 1 wherein each of the arms has a chassis and a gasket mounted on the chassis such that the gasket at least one of insulates the associated heating element from the chassis, cushions the associated heating element on the chassis, and inhibits ingress of pollutants between the associated heating element and the chassis.

7. The heated appliance of claim 1 further comprising a manually operable locking mechanism configured to inhibit the arms from closing relative to one another once opened.

8. The heated appliance of claim 1 wherein the glass substrate includes an inner pane in a first plane and an outer pane in a second plane, wherein the inner pane and the outer pane are in abutment with one another.

9. The heated appliance of claim 1 further comprising:

a thermistor attached to the heating element and configured for gauging a temperature of the heating element during operation of the appliance; and a control unit carried by the one of the arms, wherein the control unit is configured to:

sample temperature data from the heating element when the heating element is heated to a set temperature;

determine a rate of temperature change for the heating element using the sampled temperature data; and supply a percentage of full power to the heating element, wherein the percentage of full power is selected by the control unit from a plurality of percentages of full power based at least in part upon the determined rate of temperature change.

10. The heated appliance of claim 9, wherein the thermistor is coupled to the control unit for providing the sampled temperature data to the control unit, and wherein the control unit is configured to perform a protection logic operation to determine a functionality of the thermistor.

11. The heated appliance of claim 10 wherein the protection logic operation is fully executable only after a time delay.

12. The heated appliance of claim 9 wherein the control unit is configured to determine the rate of temperature change using a moving window of temperature values calculated over time.

13. The heated appliance of claim 9 wherein the plurality of percentages of full power are grouped into a first group of percentages and a second group of percentages, each group being selected by the control unit based upon whether the sampled temperature data indicates that one of a plurality of prior temperature values reached the set temperature.

14. The heated appliance of claim 13 wherein the first group of percentages is selected if none of the plurality of prior temperature values reached the set temperature.

15. The heated appliance of claim 14 wherein the first group of percentages has a maximum percentage that is less than a maximum percentage of the second group of percentages.

16. The heated appliance of claim 13 wherein the second group of percentages is selected if one of the plurality of prior temperature values reached the set temperature.

17. The heated appliance of claim 16 wherein the second group of percentages has a maximum percentage that is greater than a maximum percentage of the first group of percentages.

18. A heated appliance comprising:

a pair of arms; and a hinge attaching the arms together such that the arms are openable and closeable relative to one another via the hinge, wherein each of the arms comprises a heating element having a glass substrate and an electrically conductive material deposited on the glass substrate, wherein the glass substrate includes an inner pane and an outer pane, wherein the inner pane and the outer pane are in abutment with one another, wherein the outer pane includes an exterior face of the glass substrate and the inner pane includes an interior face of the glass substrate, wherein the exterior face is configured to contact hair when the hair is positioned between the pair of arms, and wherein the interior face is spaced from the hair by the thickness of the inner pane and the outer pane when the hair contacts the exterior face.

19. The heated appliance of claim 18 wherein the electrically conductive material is deposited on the interior face.

* * * * *